US007695123B2

(12) United States Patent
Karppinen et al.

(10) Patent No.: US 7,695,123 B2
(45) Date of Patent: Apr. 13, 2010

(54) INK SUPPLY SYSTEM WITH ACTIVE PRESSURE CONTROL

(75) Inventors: Vesa Karppinen, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 705 days.

(21) Appl. No.: 11/482,954

(22) Filed: Jul. 10, 2006

(65) Prior Publication Data

US 2007/0081053 A1 Apr. 12, 2007

Related U.S. Application Data

(63) Continuation-in-part of application No. 11/246,708, filed on Oct. 11, 2005, now Pat. No. 7,506,952.

(30) Foreign Application Priority Data

Mar. 15, 2006 (AU) ..... 2006201204

(51) Int. Cl.
*B41J 2/175* (2006.01)

(52) U.S. Cl. ..... 347/85

(58) Field of Classification Search ..... 347/5, 347/7, 84, 85; 141/2, 18
See application file for complete search history.

(56) References Cited

U.S. PATENT DOCUMENTS

| | | | | |
|---|---|---|---|---|
| 6,158,839 | A | 12/2000 | Fukushima et al. | |
| 6,224,198 | B1 * | 5/2001 | Cook et al. | 347/85 |
| 6,281,909 | B1 | 8/2001 | Fassler et al. | |
| 6,290,343 | B1 * | 9/2001 | Lewis et al. | 347/85 |
| 6,378,973 | B1 | 4/2002 | Kubota et al. | |
| 6,776,472 | B2 | 8/2004 | Itano et al. | |
| 6,796,627 | B2 * | 9/2004 | Kimura et al. | 347/7 |
| 7,063,410 | B2 * | 6/2006 | Slotto et al. | 347/86 |
| 7,484,837 | B2 * | 2/2009 | Koga et al. | 347/85 |
| 2002/0005873 | A1 | 1/2002 | Suzuki | |
| 2005/0062797 | A1 | 3/2005 | Kachi | |

FOREIGN PATENT DOCUMENTS

| | | | |
|---|---|---|---|
| DE | 3226773 | A1 | 2/1983 |
| DE | 3825046 | A1 | 1/1990 |
| EP | 1013437 | A1 | 6/2000 |
| JP | 11058901 | A | 3/1999 |
| JP | 11-268297 | A | 10/1999 |
| JP | 2003-320690 | A1 | 11/2003 |
| JP | 2004131202 | A | 4/2004 |
| JP | 2005-96125 | | 4/2005 |
| JP | 2006-43963 | A | 2/2006 |
| WO | WO 88/08370 | A1 | 11/1988 |
| WO | WO 93/21020 | A1 | 10/1993 |
| WO | WO 96/35584 | A1 | 11/1996 |

* cited by examiner

*Primary Examiner*—Anh T. N. Vo

(57) ABSTRACT

An ink supply system for an inkjet printhead is provided. The system comprises: (a) an ink reservoir for storing ink, the ink reservoir being contained in a pressurizable chamber; (b) an ink conduit providing fluid communication between the ink reservoir and the printhead; (c) an air compressor in fluid communication with the chamber; and (d) a valve switchable between a positively-pressurizing configuration and a negatively-pressurizing configuration, thereby providing active control of pressure in the ink reservoir.

10 Claims, 14 Drawing Sheets

INK SUPPLY SYSTEM WITH ACTIVE PRESSURE CONTROL

CROSS REFERENCE TO RELATED APPLICATION

The present application is a Continuation-In-Part of U.S. application Ser. No. 11/246,708 filed on Oct. 11, 2005, now issued U.S. Pat. No. 7,506,952, the entire contents of which are now incorporated by reference.

FIELD OF THE INVENTION

This invention relates to inkjet printhead maintenance. It has been developed primarily for facilitating maintenance operations, such as unblocking nozzles and/or cleaning particulates from an ink ejection face of the printhead.

CO-PENDING APPLICATIONS

The following applications have been filed by the Applicant simultaneously with the present application:

| | | | | | |
|---|---|---|---|---|---|
| 11/482,975 | 11/482,970 | 11/482,968 | 11/482,972 | 11/482,971 | 11/482,969 |
| 7,530,663 | 7,467,846 | 11/482,962 | 11/482,963 | 11/482,956 | 11/482,974 |
| 11/482,957 | 11/482,987 | 11/482,959 | 11/482,960 | 11/482,961 | 11/482,964 |
| 11/482,965 | 7,510,261 | 11/482,973 | 11/482,990 | 11/482,986 | 11/482,985 |
| 11/482,980 | 11/482,967 | 11/482,966 | 11/482,988 | 11/482,989 | 7,530,446 |
| 11/482,953 | 11/482,977 | 11/482,981 | 11/482,978 | 11/482,982 | 11/482,983 |
| 11/482,984 | | | | | |

The disclosures of these co-pending applications are incorporated herein by reference.

CROSS REFERENCES TO RELATED APPLICATIONS

Various methods, systems and apparatus relating to the present invention are disclosed in the following US Patents/Patent Applications filed by the applicant or assignee of the present invention:

| | | | | | |
|---|---|---|---|---|---|
| 6,750,901 | 6,476,863 | 6,788,336 | 7,249,108 | 6,566,858 | 6,331,946 |
| 6,246,970 | 6,442,525 | 7,346,586 | 09/505,951 | 6,374,354 | 7,246,098 |
| 6,816,968 | 6,757,832 | 6,334,190 | 6,745,331 | 7,249,109 | 7,197,642 |
| 7,093,139 | 7,509,292 | 10/636,283 | 10/866,608 | 7,210,038 | 7,401,223 |
| 10/940,653 | 10/942,858 | 7,364,256 | 7,258,417 | 7,293,853 | 7,328,968 |
| 7,270,395 | 7,461,916 | 7,510,264 | 7,334,864 | 7,255,419 | 7,284,819 |
| 7,229,148 | 7,258,416 | 7,273,263 | 7,270,393 | 6,984,017 | 7,347,526 |
| 7,357,477 | 7,465,015 | 7,364,255 | 7,357,476 | 11/003,614 | 7,284,820 |
| 7,341,328 | 7,246,875 | 7,322,669 | 7,445,311 | 7,452,052 | 7,455,383 |
| 7,448,724 | 7,441,864 | 7,506,958 | 7,472,981 | 7,448,722 | 11/246,679 |
| 7,438,381 | 7,441,863 | 7,438,382 | 7,425,051 | 7,399,057 | 11/246,671 |
| 11/246,670 | 11/246,669 | 7,448,720 | 7,448,723 | 7,445,310 | 7,399,054 |
| 7,425,049 | 7,367,648 | 7,370,936 | 7,401,886 | 7,506,952 | 7,401,887 |
| 7,384,119 | 7,401,888 | 7,387,358 | 7,413,281 | 6,623,101 | 6,406,129 |
| 6,505,916 | 6,457,809 | 6,550,895 | 6,457,812 | 7,152,962 | 6,428,133 |
| 7,204,941 | 7,282,164 | 7,465,342 | 7,278,727 | 7,417,141 | 7,452,989 |
| 7,367,665 | 7,138,391 | 7,153,956 | 7,423,145 | 7,456,277 | 7,550,585 |
| 7,122,076 | 7,148,345 | 11/172,816 | 7,470,315 | 11/172,814 | 7,416,280 |
| 7,252,366 | 7,488,051 | 7,360,865 | 7,438,371 | 7,465,017 | 7,441,862 |
| 11/293,841 | 7,458,659 | 11/293,797 | 7,455,376 | 6,746,105 | 11/246,687 |
| 11/246,718 | 7,322,681 | 11/246,686 | 11/246,703 | 11/246,691 | 7,510,267 |
| 7,465,041 | 11/246,712 | 7,465,032 | 7,401,890 | 7,401,910 | 7,470,010 |
| 11/246,702 | 7,431,432 | 7,465,037 | 7,445,317 | 7,549,735 | 11/246,675 |
| 11/246,674 | 11/246,667 | 7,156,508 | 7,159,972 | 7,083,271 | 7,165,834 |
| 7,080,894 | 7,201,469 | 7,090,336 | 7,156,489 | 7,413,283 | 7,438,385 |
| 7,083,257 | 7,258,422 | 7,255,423 | 7,219,980 | 10/760,253 | 7,416,274 |
| 7,367,649 | 7,118,192 | 10/760,194 | 7,322,672 | 7,077,505 | 7,198,354 |
| 7,077,504 | 10/760,189 | 7,198,355 | 7,401,894 | 7,322,676 | 7,152,959 |
| 7,213,906 | 7,178,901 | 7,222,938 | 7,108,353 | 7,104,629 | 7,303,930 |
| 7,401,405 | 7,464,466 | 7,464,465 | 7,246,886 | 7,128,400 | 7,108,355 |
| 6,991,322 | 7,287,836 | 7,118,197 | 10/728,784 | 7,364,269 | 7,077,493 |
| 6,962,402 | 10/728,803 | 7,147,308 | 7,524,034 | 7,118,198 | 7,168,790 |
| 7,172,270 | 7,229,155 | 6,830,318 | 7,195,342 | 7,175,261 | 7,465,035 |
| 7,108,356 | 7,118,202 | 7,510,269 | 7,134,744 | 7,510,270 | 7,134,743 |
| 7,182,439 | 7,210,768 | 7,465,036 | 7,134,745 | 7,156,484 | 7,118,201 |
| 7,111,926 | 7,431,433 | 7,018,021 | 7,401,901 | 7,468,139 | 11/188,017 |

-continued

| | | | | | |
|---|---|---|---|---|---|
| 7,128,402 | 7,387,369 | 7,484,832 | 11/097,308 | 7,448,729 | 7,246,876 |
| 7,431,431 | 7,419,249 | 7,377,623 | 7,328,978 | 7,334,876 | 7,147,306 |
| 09/575,197 | 7,079,712 | 6,825,945 | 7,330,974 | 6,813,039 | 6,987,506 |
| 7,038,797 | 6,980,318 | 6,816,274 | 7,102,772 | 7,350,236 | 6,681,045 |
| 6,728,000 | 7,173,722 | 7,088,459 | 09/575,181 | 7,068,382 | 7,062,651 |
| 6,789,194 | 6,789,191 | 6,644,642 | 6,502,614 | 6,622,999 | 6,669,385 |
| 6,549,935 | 6,987,573 | 6,727,996 | 6,591,884 | 6,439,706 | 6,760,119 |
| 7,295,332 | 6,290,349 | 6,428,155 | 6,785,016 | 6,870,966 | 6,822,639 |
| 6,737,591 | 7,055,739 | 7,233,320 | 6,830,196 | 6,832,717 | 6,957,768 |
| 7,456,820 | 7,170,499 | 7,106,888 | 7,123,239 | 10/727,181 | 10/727,162 |
| 7,377,608 | 7,399,043 | 7,121,639 | 7,165,824 | 7,152,942 | 10/727,157 |
| 7,181,572 | 7,096,137 | 7,302,592 | 7,278,034 | 7,188,282 | 10/727,159 |
| 10/727,180 | 10/727,179 | 10/727,192 | 10/727,274 | 10/727,164 | 7,523,111 |
| 10/727,198 | 10/727,158 | 10/754,536 | 10/754,938 | 10/727,160 | 10/934,720 |
| 7,171,323 | 7,278,697 | 7,369,270 | 6,795,215 | 7,070,098 | 7,154,638 |
| 6,805,419 | 6,859,289 | 6,977,751 | 6,398,332 | 6,394,573 | 6,622,923 |
| 6,747,760 | 6,921,144 | 10/884,881 | 7,092,112 | 7,192,106 | 7,457,001 |
| 7,173,739 | 6,986,560 | 7,008,033 | 7,551,324 | 7,222,780 | 7,270,391 |
| 7,195,328 | 7,182,422 | 7,374,266 | 7,427,117 | 7,448,707 | 7,281,330 |
| 10/854,503 | 7,328,956 | 10/854,509 | 7,188,928 | 7,093,989 | 7,377,609 |
| 10/854,495 | 10/854,498 | 10/854,511 | 7,390,071 | 10/854,525 | 10/854,526 |
| 7,549,715 | 7,252,353 | 10/854,515 | 7,267,417 | 10/854,505 | 7,517,036 |
| 7,275,805 | 7,314,261 | 10/854,490 | 7,281,777 | 7,290,852 | 7,484,831 |
| 10/854,523 | 10/854,527 | 7,549,718 | 10/854,520 | 10/854,514 | 10/854,519 |
| 10/854,513 | 10/854,499 | 10/854,501 | 7,266,661 | 7,243,193 | 10/854,518 |
| 10/934,628 | 7,163,345 | 7,465,033 | 7,452,055 | 7,470,002 | 11/293,833 |
| 7,475,963 | 7,448,735 | 7,465,042 | 7,448,739 | 7,438,399 | 11/293,794 |
| 7,467,853 | 7,461,922 | 7,465,020 | 11/293,830 | 7,461,910 | 11/293,828 |
| 7,270,494 | 11/293,823 | 7,475,961 | 7,547,088 | 11/293,815 | 11/293,819 |
| 11/293,818 | 11/293,817 | 11/293,816 | 7,448,734 | 7,425,050 | 7,364,263 |
| 7,201,468 | 7,360,868 | 7,234,802 | 7,303,255 | 7,287,846 | 7,156,511 |
| 10/760,264 | 7,258,432 | 7,097,291 | 10/760,222 | 10/760,248 | 7,083,273 |
| 7,367,647 | 7,374,355 | 7,441,880 | 7,547,092 | 10/760,206 | 7,513,598 |
| 10/760,270 | 7,198,352 | 7,364,264 | 7,303,251 | 7,201,470 | 7,121,655 |
| 7,293,861 | 7,232,208 | 7,328,985 | 7,344,232 | 7,083,272 | 11/014,764 |
| 11/014,763 | 7,331,663 | 7,360,861 | 7,328,973 | 7,427,121 | 7,407,262 |
| 7,303,252 | 7,249,822 | 7,537,309 | 7,311,382 | 7,360,860 | 7,364,257 |
| 7,390,075 | 7,350,896 | 7,429,096 | 7,384,135 | 7,331,660 | 7,416,287 |
| 7,488,052 | 7,322,684 | 7,322,685 | 7,311,381 | 7,270,405 | 7,303,268 |
| 7,470,007 | 7,399,072 | 7,393,076 | 11/014,750 | 11/014,749 | 7,249,833 |
| 7,524,016 | 7,490,927 | 7,331,661 | 7,524,043 | 7,300,140 | 7,357,492 |
| 7,357,493 | 11/014,766 | 7,380,902 | 7,284,816 | 7,284,845 | 7,255,430 |
| 7,390,080 | 7,328,984 | 7,350,913 | 7,322,671 | 7,380,910 | 7,431,424 |
| 7,470,006 | 11/014,732 | 7,347,534 | 7,441,865 | 7,469,989 | 7,367,650 |
| 7,469,990 | 7,441,882 | 11/293,822 | 7,357,496 | 7,467,863 | 7,431,440 |
| 7,431,443 | 7,527,353 | 7,524,023 | 7,513,603 | 7,467,852 | 7,465,045 |

The disclosures of these applications and patents are incorporated herein by reference.

BACKGROUND OF THE INVENTION

Inkjet printers are commonplace in homes and offices. However, all commercially available inkjet printers suffer from slow print speeds, because the printhead must scan across a stationary sheet of paper. After each sweep of the printhead, the paper advances incrementally until a complete printed page is produced.

It is a goal of inkjet printing to provide a stationary pagewidth printhead, whereby a sheet of paper is fed continuously past the printhead, thereby increasing print speeds greatly. The present Applicant has developed many different types of pagewidth inkjet printheads using MEMS technology, some of which are described in the patents and patent applications listed in the cross-reference section above. The contents of these patents and patent applications are incorporated herein by cross-reference in their entirety.

Notwithstanding the technical challenges of producing a pagewidth inkjet printhead, a crucial aspect of any inkjet printing is maintaining the printhead in an operational printing condition throughout its lifetime. A number of factors may cause an inkjet printhead to become non-operational and it is important for any inkjet printer to include a strategy for preventing printhead failure and/or restoring the printhead to an operational printing condition in the event of failure. Printhead failure may be caused by, for example, printhead face flooding, dried-up nozzles (due to evaporation of water from the nozzles—a phenomenon known in the art as decap), or particulates fouling nozzles.

Particulates, in the form of paper dust, are a particular problem in high-speed pagewidth printing. This is because the paper is typically fed at high speed over a paper guide and past the printhead. Frictional contact of the paper with the paper guide generates large quantities of paper dust compared to traditional scanning inkjet printheads, where paper is fed much more slowly. Hence, pagewidth printheads tend to accumulate paper dust on their ink ejection face during printing. This accumulation of paper dust is highly undesirable.

In the worst case scenario, paper dust blocks nozzles on the printhead, preventing those nozzles from ejecting ink. More usually, paper dust overlies nozzles and partially covers nozzle apertures. Nozzle apertures that are partially covered or blocked produce misdirected ink droplets during printing—the ink droplets are deflected from their intended trajectory by particulates on the ink ejection face. Misdirects are highly undesirable and may result in acceptably low print quality.

One measure that has been used for maintaining printheads in an operational condition is sealing the printhead, which prevents the ingress of particulates and also prevents evaporation of ink from nozzles. Commercial inkjet printers are typically supplied with a sealing tape across the printhead, which the user removes when the printer is installed for use. The sealing tape protects the primed printhead from particulates and prevents the nozzles from drying up during transit. Sealing tape also controls flooding of ink over the printhead face.

Aside from one-time use sealing tape on new printers, sealing has also been used as a strategy for maintaining printheads in an operational condition during printing. In some commercial printers, a gasket-type sealing ring and cap engages around a perimeter of the printhead when the printer is idle. A vacuum may be connected to the sealing cap and used to suck ink from the nozzles, unblocking any nozzles that have dried up. However, whilst sealing/vacuum caps may prevent the ingress of particulates from the atmosphere, such measures do not remove particulates already built up on the printhead.

In order to remove flooded ink from a printhead after vacuum flushing, prior art maintenance stations typically employ a rubber squeegee, which is wiped across the printhead. Particulates are removed from the printhead by flotation into the flooded ink and the squeegee removes the flooded ink having particulates dispersed therein.

However, rubber squeegees have several shortcomings when used with MEMS pagewidth printheads. A typical MEMS printhead has a nozzle plate comprised of a hard, durable material such as silicon nitride, silicon oxide, aluminium nitride etc. Moreover, the nozzle plate is typically relatively abrasive due to etched features on its surface. On the one hand, it is important to protect the nozzle plate, comprising sensitive nozzle structures, from damaging exposure to the shear forces exerted by a rubber squeegee. On the other hand, it is equally important that a rubber squeegee should not be damaged by contact with the printhead and reduce its cleaning efficacy.

Therefore, it would be desirable to provide an inkjet printhead maintenance station, which does not rely on a rubber squeegee wiping across the nozzle plate to remove flood ink and particulates. It would further be desirable to provide an inkjet printhead maintenance station, which removes flooded ink and particulates from the nozzle plate without the nozzle plate coming into contact with any cleaning surface.

It would further be desirable to provide an ink jet printhead maintenance station that is simple in design, does not consume large amounts power and can be readily incorporated into a desktop printer.

It would further be desirable to facilitate printhead maintenance by providing an ink supply system, which purges ink onto an ink ejection face of a printhead in an efficient and controlled manner

SUMMARY OF THE INVENTION

In a first aspect, there is provided a method of removing particulates from an ink ejection face of a printhead, the method comprising the steps of:

(i) flooding the face with ink from the printhead, thereby dispersing the particulates into the flooded ink; and (ii) transferring the flooded ink, including the particulates, onto a transfer surface moving past the face, wherein the transfer surface does not contact the face.

Optionally, the transfer surface contacts the flooded ink when moving past the face.

Optionally, the transfer surface is less than 2 mm, less than 1 mm or less than 0.5 mm from the face when moving past the face.

Optionally, a sealing member is positioned adjacent the printhead, such that at least part of the transfer surface, the face and the sealing member define a cavity when the transfer surface moves past the face.

Optionally, the transfer surface forms a fluidic seal with the sealing member.

Optionally, the transfer surface is an outer surface of a first transfer roller.

Optionally, the transfer surface is moved past the face by rotating the roller.

Optionally, the roller is substantially coextensive with the printhead.

Optionally, the face is flooded with ink by positively pressurizing an ink reservoir or ink conduit supplying ink to the printhead.

Optionally, an amount and/or a period of pressure applied to the ink reservoir or ink conduit is controlled.

Optionally, an ink conduit between the ink reservoir and the printhead comprises a valve for controlling an amount of ink flooded onto the face.

Optionally, the method further comprises the step of:

(iii) removing ink from the transfer surface using an ink removal system.

Optionally, the transfer surface is an outer surface of a first transfer roller and the ink removal system comprises a cleaning pad in contact with the first transfer roller.

Optionally, the transfer surface is an outer surface of a first transfer roller and the ink removal system comprises a second transfer roller engaged with the first transfer roller.

Optionally, the second transfer roller has a wetting surface for receiving ink from the transfer surface.

Optionally, the second transfer roller is a metal roller.

Optionally, the second transfer roller is positioned distal from the printhead.

Optionally, a cleaning pad is in contact with the second transfer roller.

Optionally, the second transfer roller and the cleaning pad are substantially coextensive with the first transfer roller.

In a second aspect, there is provided a printhead maintenance system for maintaining a printhead in an operable condition, the maintenance system comprising:

(a) a printhead having an ink ejection face;

(b) an ink supply system comprising a face flooding system for flooding ink from the printhead onto the face; and (c) an ink transport assembly comprising:

a transfer surface for receiving flooded ink from the face; and a transport mechanism for feeding the transfer surface through a transfer zone and away from the printhead, wherein the transfer zone is adjacent to and spaced apart from the face.

Optionally, the printhead is a pagewidth inkjet printhead.

Optionally, the face flooding system comprises a pressure system for positively pressurizing an ink reservoir or an ink conduit supplying ink to the printhead.

Optionally, the pressure system comprises a control system for controlling an amount and/or a period of pressure applied to the ink reservoir or the ink conduit.

Optionally, an ink conduit between the ink reservoir and the printhead comprises a valve for controlling an amount of ink flooded onto the face.

Optionally, the transfer surface is an outer surface of a first transfer roller.

Optionally, the transfer surface is fed through the transfer zone by rotating the roller.

Optionally, the roller is substantially coextensive with the printhead.

Optionally, the transfer zone is spaced less than 2 mm, less than 1 mm or less than 0.5 mm from the face.

Optionally, a sealing member is positioned adjacent the printhead, such that at least part of the transfer surface, the face and the sealing member define a cavity when the transfer surface is fed through the transfer zone.

Optionally, the transfer surface forms a fluidic seal with the sealing member.

Optionally, the ink transport assembly is moveable between a first position in which the transfer surface is positioned in the transfer zone and a second position in which the transfer surface is positioned remotely from the printhead.

Optionally, the maintenance system further comprises:

(d) an ink removal system for removing ink from the transfer surface.

Optionally, the transfer surface is an outer surface of a first transfer roller and the ink removal system comprises a cleaning pad in contact with the first transfer roller.

Optionally, the transfer surface is an outer surface of a first transfer roller and the ink removal system comprises a second transfer roller engaged with the first transfer roller.

Optionally, the second transfer roller has a wetting surface for receiving ink from the transfer surface.

Optionally, the second transfer roller is a metal roller.

Optionally, a cleaning pad is in contact with the second transfer roller.

Optionally, the second transfer roller and the cleaning pad are substantially coextensive with the first transfer roller.

In a third aspect, there is provided a method of removing flooded ink from an ink ejection face of a printhead, the method comprising transferring the ink onto a transfer surface moving past the face, wherein the transfer surface does not contact the face.

Optionally, the transfer surface contacts the flooded ink when moving past the face.

Optionally, the transfer surface is less than 1 mm from the face when moving past the face.

Optionally, a sealing member is positioned adjacent the printhead, such that at least part of the transfer surface, the face and the sealing member define a cavity when the transfer surface moves past the face.

Optionally, the transfer surface forms a fluidic seal with the sealing member.

Optionally, the transfer surface is an outer surface of a first transfer roller.

Optionally, the transfer surface is moved past the face by rotating the roller.

Optionally, the roller is substantially coextensive with the printhead.

Optionally, the face is flooded with ink by positively pressurizing an ink reservoir supplying ink to the printhead.

Optionally, an amount and/or a period of pressure applied to the ink reservoir is controlled.

Optionally, an ink conduit between the ink reservoir and the printhead comprises a valve for controlling an amount of ink flooded onto the face.

Optionally, the method further comprises removing ink from the transfer surface using an ink removal system.

Optionally, the transfer surface is an outer surface of a first transfer roller and the ink removal system comprises a cleaning pad in contact with the first transfer roller.

Optionally, the transfer surface is an outer surface of a first transfer roller and the ink removal system comprises a second transfer roller engaged with the first transfer roller.

Optionally, the second transfer roller has a wetting surface for receiving ink from the transfer surface.

Optionally, the second transfer roller is a metal roller.

Optionally, the second transfer roller is positioned distal from the printhead.

Optionally, a cleaning pad is in contact with the second transfer roller.

Optionally, the second transfer roller and the cleaning pad are substantially coextensive with the first transfer roller.

In a fourth aspect, there is provided an ink supply system for an inkjet printhead comprising:

(a) an ink reservoir for storing ink;

(b) an ink conduit providing fluid communication between the ink reservoir and the printhead;

(c) a pressure device for positively pressurizing the ink reservoir; and (d) a valve in the ink conduit for controlling a supply of ink to the printhead.

Optionally, the ink supply system comprises a plurality of ink reservoirs.

Optionally, each ink reservoir has a respective ink conduit providing fluid communication between each ink reservoir and the printhead.

Optionally, each ink conduit has a respective valve.

Optionally, the valve is a solenoid valve.

Optionally, the ink supply system further comprises a controller for controlling operation of the pressure device and the valve.

Optionally, the ink supply system further comprises a pressure sensor for measuring a pressure in the ink reservoir or the ink conduit.

Optionally, the pressure sensor is in communication with the controller, the controller being configured to control the pressure device in response to feedback provided by the pressure sensor.

Optionally, the controller is configured to coordinate a printhead purge operation using the pressure device, the pressure sensor and the valve.

Optionally, the controller is configured to coordinate the following steps in response to a request for printhead purging:

(i) close the valve;

(ii) pressurize the ink reservoir using the pressure device;

(iii) monitor a pressure in the ink reservoir or the ink conduit using the pressure sensor; and (iv) open the valve for a predetermined period when a predetermined pressure has been reached.

Optionally, the ink reservoir comprises a pressure-biasing means for biasing a pressure in the reservoir towards a negative pressure.

Optionally, the ink-reservoir comprises an ink bag containing ink.

In a fifth aspect, there is provided an ink supply system for an inkjet printhead comprising:

(a) an ink reservoir for storing ink;

(b) an ink conduit providing fluid communication between the ink reservoir and the printhead;

(c) a pressure device for positively pressurizing the ink reservoir, the pressure device comprising a compression mechanism for compressing the ink reservoir; and (d) a valve in the ink conduit for controlling a supply of ink to the printhead.

Optionally, the ink supply system comprises a plurality of ink reservoirs.

Optionally, each ink reservoir has a respective ink conduit providing fluid communication between each ink reservoir and the printhead.

Optionally, each ink conduit has a respective valve.

Optionally, the valve is a solenoid valve.

Optionally, the ink supply system further comprises a controller for controlling operation of the pressure device and the valve.

Optionally, the ink supply system further comprises a pressure sensor for measuring a pressure in the ink reservoir or the ink conduit.

Optionally, the pressure sensor is in communication with the controller, the controller being configured to control the pressure device in response to feedback provided by the pressure sensor.

Optionally, the controller is configured to coordinate a printhead purge operation using the pressure device, the pressure sensor and the valve.

Optionally, the controller is configured to coordinate the following steps in response to a request for printhead purging:

(i) close the valve;

(ii) pressurize the ink reservoir using the pressure device;

(iii) monitor a pressure in the ink reservoir or the ink conduit using the pressure sensor; and (iv) open the valve for a predetermined period when a predetermined pressure has been reached.

Optionally, the ink reservoir comprises a pressure-biasing means for biasing a pressure in the reservoir towards a negative pressure.

Optionally, the ink reservoir comprises an ink bag containing ink.

Optionally, the compression mechanism comprises a compression member for compressing abutment with a wall of the ink bag.

In a sixth aspect, there is provided an ink supply system for an inkjet printhead comprising:

(a) an ink reservoir for storing ink, the ink reservoir being contained in a pressurizable chamber;

(b) an ink conduit providing fluid communication between the ink reservoir and the printhead;

(c) a pressure device for positively pressurizing the chamber, the pressure device comprising an air compressor in fluid communication with the chamber; and (d) a valve in the ink conduit for controlling a supply of ink to the printhead.

Optionally, the ink supply system comprises a plurality of ink reservoirs.

Optionally, each ink reservoir has a respective ink conduit providing fluid communication between each ink reservoir and the printhead.

Optionally, each ink conduit has a respective valve.

Optionally, the valve is a solenoid valve.

Optionally, the ink supply system further comprises a controller for controlling operation of the pressure device and the valve.

Optionally, the ink supply system further comprises a pressure sensor for measuring a pressure in the ink reservoir or the ink conduit.

Optionally, the pressure sensor is in communication with the controller, the controller being configured to control the pressure device in response to feedback provided by the pressure sensor.

Optionally, the controller is configured to coordinate a printhead purge operation using the pressure device, the pressure sensor and the valve.

Optionally, the controller is configured to coordinate the following steps in response to a request for printhead purging:

(i) close the valve;

(ii) pressurize the ink reservoir using the pressure device;

(iii) monitor a pressure in the ink reservoir or the ink conduit using the pressure sensor; and (iv) open the valve for a predetermined period when a predetermined pressure has been reached;

Optionally, the air compressor is configurable for negatively pressurizing the pressure chamber.

Optionally, the ink reservoir comprises an ink bag containing ink.

In a seventh aspect, there is provided an ink supply system for an inkjet printhead comprising:

(a) an ink reservoir for storing ink, the ink reservoir being contained in a pressurizable chamber;

(b) an ink conduit providing fluid communication between the ink reservoir and the printhead;

(c) an air compressor in fluid communication with the chamber; and (d) a valve switchable between a positively-pressurizing configuration and a negatively-pressurizing configuration, thereby providing active control of ink pressure in the ink reservoir.

Optionally, the ink supply system comprises a plurality of ink reservoirs.

Optionally, each ink reservoir has a respective ink conduit providing fluid communication between each ink reservoir and the printhead.

Optionally, the switchable valve is a solenoid valve.

Optionally, the ink supply system further comprises a controller for controlling operation of the air compressor and the switchable valve.

Optionally, the ink supply system further comprises a pressure sensor for measuring a pressure in the ink reservoir or the ink conduit.

Optionally, the pressure sensor is in communication with the controller, the controller being configured to control the air compressor and the switchable valve in response to feedback provided by the pressure sensor.

Optionally, the switchable valve is positioned in an air conduit between the air compressor and the chamber.

Optionally, in the positively-pressurizing configuration, the switchable valve connects an outlet of the air compressor to the chamber.

Optionally, in the negatively-pressurizing configuration, the switchable valve connects an inlet of the air compressor to the chamber.

Optionally, the ink reservoir comprises an ink bag containing ink.

Optionally, the ink conduit has a respective ink valve for controlling a supply of ink to the printhead.

Optionally, the ink conduit has a respective ink valve for controlling a supply of ink to the printhead, and the controller is configured for controlling operation of the ink valve.

In an eighth aspect, there is provided a method of purging ink from an inkjet printhead, the printhead being in fluid communication with an ink reservoir via an ink conduit having a valve, the method comprising:

(i) closing the valve;

(ii) positively pressurizing the ink reservoir using a pressure device; and (iii) opening the valve for a predetermined period, thereby purging ink from the printhead and flooding an ink ejection face of the printhead.

Optionally, the printhead is in fluid communication with a plurality of ink reservoirs.

Optionally, a respective ink conduit provides fluid communication between each ink reservoir and the printhead.

Optionally, each ink conduit has a respective valve.

Optionally, the valve is a solenoid valve.

Optionally, operation of the pressure device and the valve is controlled using a controller.

Optionally, the method further comprises measuring a pressure in the ink reservoir or the ink conduit using a pressure sensor.

Optionally, the method further comprises controlling the pressure device in response to feedback provided by the pressure sensor to the controller.

Optionally, the method further comprises coordinating a printhead purge operation using the pressure device, the pressure sensor and the valve.

Optionally, the method further comprises the step of monitoring a pressure in the ink reservoir or the ink conduit using the pressure sensor, and opening the valve when a predetermined pressure has been reached.

Optionally, the ink reservoir comprises a pressure-biasing means for biasing a pressure in the reservoir towards a negative pressure.

Optionally, the ink reservoir comprises an ink bag containing ink.

Optionally, the method further comprises the step of transferring the flooded ink onto a transfer surface moving past the face, wherein the transfer surface does not contact the face.

Optionally, the transfer surface is an outer surface of a roller.

Optionally, the transfer surface is moved past the face by rotating the roller.

Optionally, the method further comprises the step of removing ink from the transfer surface using an ink removal system.

Optionally, the pressure device comprises a compression mechanism.

Optionally, the pressure device comprises an air compressor.

In a ninth aspect, there is provided an ink supply system for an inkjet printhead comprising:

(a) an ink reservoir for storing ink;

(b) an ink conduit providing fluid communication between the ink reservoir and the printhead; and (c) a hammer mechanism for compressing part of the ink conduit.

Optionally, the ink supply system comprises a plurality of ink reservoirs.

Optionally, each ink reservoir has a respective ink conduit providing fluid communication between each ink reservoir and the printhead.

Optionally, the ink supply system further comprises:

(d) a conduit expander for expanding the part of the ink conduit.

Optionally, the conduit expander is positioned within the ink conduit.

Optionally, the conduit expander is resiliently biased towards an expanded configuration.

Optionally, the conduit expander comprises a diaphragm, a balloon or a spring.

Optionally, the hammer mechanism comprises a hammer head for urging abutment with a wall of the part of the conduit.

Optionally, a volume of the part of the conduit is defined by a position of the hammer head.

Optionally, the hammer mechanism comprises a spring-loading mechanism for priming the hammer head.

Optionally, the spring-loading mechanism comprises a release mechanism for releasing a primed hammer head.

Optionally, the spring-loading mechanism has a plurality of spring-loaded configurations.

Optionally, each spring-loaded configuration has an associated printhead purging pressure.

Optionally, each spring-loaded configuration has an associated printhead purging volume.

Optionally, the ink supply system further comprises a controller for controlling operation of the hammer mechanism.

Optionally, the ink supply system further comprises:

(e) a first valve in the ink conduit positioned between the ink reservoir and the conduit expander.

Optionally, the ink supply system further comprises:

(f) a second valve in the ink conduit positioned between the conduit expander and the printhead.

Optionally, the first and second valves are pinch valves.

Optionally, the ink supply system further comprises a controller for controlling operation of the hammer mechanism, the first valve and the second valve.

Optionally, the controller is configured to coordinate a printhead purge operation using the hammer mechanism, the first valve and the second valve.

In a tenth aspect, there is provided a method of purging ink from an inkjet printhead, the printhead being in fluid communication with an ink reservoir via an ink conduit, the method comprising compressing part of the ink conduit using a hammer mechanism, thereby purging ink from the printhead and flooding an ink ejection face of the printhead.

Optionally, the printhead is in fluid communication with a plurality of ink reservoirs via a plurality of ink conduits.

Optionally, the method further comprises expanding the part of the ink conduit prior to compressing using the hammer mechanism.

Optionally, a conduit expander is positioned within the ink conduit for expanding the part of the ink conduit.

Optionally, the conduit expander is biased towards an expanded configuration.

Optionally, the conduit expander comprises a diaphragm, a balloon or a spring.

Optionally, the hammer mechanism comprises a hammer head for urging abutment with a wall of the part of the conduit.

Optionally, a volume of the part of the conduit is defined by a position of the hammer head.

Optionally, the hammer mechanism comprises a spring-loading mechanism for priming the hammer head.

Optionally, the ink conduit comprises a first valve positioned between the ink reservoir and the conduit expander.

Optionally, the ink conduit comprises a second valve positioned between the conduit expander and the printhead.

Optionally, the first and second valves are pinch valves.

Optionally, the purging comprises the steps of:

(i) configuring the ink supply system such that the first valve is open and the second valve is closed;

(ii) priming the hammer mechanism and expanding the part of the ink conduit;

(iii) closing the first valve;

(iv) opening the second valve; and (v) releasing the hammer mechanism, thereby compressing the part of the ink conduit and purging the printhead.

Optionally, priming the hammer mechanism in step (ii) causes expansion of the part of the ink conduit due to a bias of a conduit expander in the ink conduit.

Optionally, all the steps are controlled by a controller communicating with the hammer mechanism and the first and second valves.

Optionally, an extent of priming is controlled by the controller, thereby controlling a purge pressure and/or a purge volume.

Optionally, the controller receives feedback from the printhead relating to a purge pressure and/or purge volume required.

Optionally, the controller determines a required purge pressure and/or purge volume based on a period in which the printhead has been idle.

In an eleventh aspect, there is provided a method of removing particulates from an ink ejection face of a printhead, the method comprising the steps of:

(i) flooding the face with ink from the printhead, thereby dispersing the particulates into the flooded ink; and (ii) transferring the flooded ink, including the particulates, onto a disposable sheet moving through a maintenance zone adjacent the face, wherein the sheet does not contact the face.

Optionally, the sheet contacts the flooded ink when moving past the face.

Optionally, flooded ink is wicked onto the sheet.

Optionally, the sheet is a paper sheet.

Optionally, the sheet has a high absorbency for absorbing the ink.

Optionally, the sheet is different from print media used for printing.

Optionally, the sheet is less than 2 mm, less than 1 mm or less than 0.5 mm from the face when moving past the face.

Optionally, a sealing member is positioned adjacent the printhead, such that at least part of the sheet, the face and the sealing member define a cavity when the sheet moves past the face.

Optionally, the face is flooded with ink by positively pressurizing an ink reservoir or ink conduit supplying ink to the printhead.

Optionally, an amount and/or a period of pressure applied to the ink reservoir or ink conduit is controlled.

Optionally, an ink conduit between the ink reservoir and the printhead comprises a valve for controlling an amount of ink flooded onto the face.

Optionally, the method further comprises the step of:

(iii) expelling the sheet from a printer comprising the printhead.

Optionally, the sheet is fed past the face using a feed mechanism.

Optionally, the sheet is manually fed past the face.

Optionally, the printhead has an associated print zone through which print media are fed for printing.

Optionally, the maintenance zone is nearer the face than the print zone.

In a twelfth aspect, there is provided a method of removing flooded ink from an ink ejection face of a printhead, the method comprising transferring the ink onto a disposable sheet moving past the face, wherein the sheet does not contact the face.

Optionally, the sheet contacts the flooded ink when moving past the face.

Optionally, flooded ink is wicked onto the sheet.

Optionally, the sheet is a paper sheet.

Optionally, the sheet has a high absorbency for absorbing the ink.

Optionally, the sheet is different from print media used for printing.

Optionally, the sheet is less than 2 mm, less than 1 mm or less than 0.5 mm from the face when moving past the face.

Optionally, a sealing member is positioned adjacent the printhead, such that at least part of the sheet, the face and the sealing member define a cavity when the sheet moves past the face.

Optionally, the face is flooded with ink by positively pressurizing an ink reservoir or ink conduit supplying ink to the printhead.

Optionally, an amount and/or a period of pressure applied to the ink reservoir or ink conduit is controlled.

Optionally, an ink conduit between the ink reservoir and the printhead comprises a valve for controlling an amount of ink flooded onto the face.

Optionally, the method further comprises the step of expelling the sheet from a printer comprising the printhead.

Optionally, the sheet is fed past the face using a feed mechanism.

Optionally, the sheet is manually fed past the face.

Optionally, the printhead has an associated print zone through which print media are fed for printing.

Optionally, the maintenance zone is nearer the face than the print zone.

In a thirteenth aspect, there is provided a printhead maintenance system for maintaining a printhead in an operable condition, the maintenance system comprising:

(a) a printhead having an ink ejection face;

(b) an ink supply system comprising a face flooding system for flooding ink from the printhead onto the face; and (c) a sheet feed arrangement for feeding a disposable sheet through a maintenance zone spaced apart from the face; and (d) a print media feed arrangement for feeding print media through a print zone, wherein the maintenance zone is nearer the face than the print zone.

Optionally, the printhead is a pagewidth inkjet printhead.

Optionally, the face flooding system comprises a pressure system for positively pressurizing an ink reservoir or an ink conduit supplying ink to the printhead.

Optionally, the pressure system comprises a control system for controlling an amount and/or a period of pressure applied to the ink reservoir or the ink conduit.

Optionally, an ink conduit between the ink reservoir and the printhead comprises a valve for controlling an amount of ink flooded onto the face.

Optionally, the sheet is a disposable sheet.

Optionally, the sheet contacts flooded ink when moving past the face.

Optionally, the flooded ink is wicked onto the sheet.

Optionally, the sheet is a paper sheet.

Optionally, the sheet has a high absorbency for absorbing the ink.

Optionally, the sheet is different from the print media.

Optionally, the maintenance zone is spaced less than 2 mm, less than 1 mm or less than 0.5 mm from the face.

Optionally, a sealing member is positioned adjacent the printhead, such that at least part of the sheet, the face and the sealing member define a cavity when the sheet moves past the face.

Optionally, the sheet feed arrangement comprises a sheet feed mechanism for automatically feeding the sheet through the maintenance zone.

Optionally, the sheet feed arrangement is configured for manually feeding the sheet through the maintenance zone.

Optionally, the sheet feed arrangement is configured to expel the disposable sheet from a printer comprising the maintenance system.

In a fourteenth aspect, there is provided an ink supply system for purging an inkjet printhead, the ink supply system comprising:

(a) a first ink reservoir for supplying printing ink to the printhead;

(b) a second ink reservoir for supplying purging ink to the printhead; and (c) a valve having a plurality of configurations, wherein:

in a first configuration the valve provides fluid communication between the printhead and the first ink reservoir via a first ink conduit; and in a second configuration the valve provides fluid communication between the printhead and the second ink reservoir via a second ink conduit.

Optionally, in a third configuration, the valve seals the printhead from the first and second ink reservoirs.

Optionally, the first ink reservoir comprises a pressure-biasing means for biasing a pressure in the reservoir towards a negative pressure.

Optionally, the ink supply system further comprises:

(d) a pressure device for positively pressurizing the second ink reservoir.

Optionally, the valve is a solenoid valve.

Optionally, the ink supply system further comprises a controller for controlling operation of the valve.

Optionally, the ink supply system further comprises a controller for controlling operation of the valve and the pressure device.

Optionally, the controller is configured to coordinate a printhead purging operation using the pressure device and the valve.

Optionally, the printing ink is identical to the purging ink.

Optionally, the ink supply system comprises a plurality of first ink reservoirs, each first reservoir having a respective second reservoir and a respective valve.

In a fifteenth aspect, there is provided a method of purging and printing from an inkjet printhead, the method comprising the steps of:

(i) fluidically connecting the printhead to a second ink reservoir containing purging ink;

(ii) purging the printhead using the purging ink, thereby flooding an ink ejection face of the printhead;

(iii) removing the flooded ink from the ink ejection face;

(iv) fluidically connecting the printhead to a first reservoir containing printing ink; and (v) printing from the printhead using the printing ink.

Optionally, the fluidic connections are made by means of a valve having a plurality of configurations.

Optionally, the method comprises the further step of sealing the printhead from the first and second ink reservoirs by fluidically connecting the printhead to a seal.

Optionally, the first ink reservoir comprises a pressure-biasing means for biasing a pressure in the reservoir towards a negative pressure.

Optionally, the purging step is performed by positively pressurizing the second ink reservoir.

Optionally, the second ink reservoir has an associated pressure device for positively pressurizing the second ink reservoir.

Optionally, operation of the valve is controlled by a controller.

Optionally, at least step (i) to (iv) are controlled by a controller.

Optionally, the printing ink is identical to the purging ink.

Optionally, the printhead is fluidically connected to a plurality of second reservoirs in step (i), and the printhead is fluidically connected to a plurality of first reservoirs in step (iv).

Optionally, the flooded ink is removed by a disposable sheet being fed past the ink ejection face.

Optionally, the sheet contacts the flooded ink when moving past the face.

Optionally, flooded ink is wicked onto the sheet.

Optionally, the sheet is a paper sheet.

Optionally, the sheet has a high absorbency for absorbing the ink.

Optionally, the sheet is different from print media used for printing.

In a sixteenth aspect, there is provided a printhead assembly comprising:

(a) an inkjet printhead; and (b) a plurality of ink reservoirs in fluid communication with nozzles in the printhead, wherein at least one of the ink reservoirs contains a cleaning liquid for cleaning an ink ejection face of the printhead.

Optionally, the cleaning liquid is water, a dyeless ink base, an aqueous surfactant solution or an aqueous glycol solution.

Optionally, the printhead assembly further comprises:

(c) a pressure device for positively pressurizing the ink reservoir containing the cleaning liquid.

Optionally, the printhead assembly further comprises:

(d) an ink conduit providing fluid communication between the ink reservoir and the printhead; and (e) a valve in the ink conduit for controlling a supply of cleaning liquid to the printhead.

Optionally, the valve is a solenoid valve.

Optionally, the printhead assembly further comprises a controller for controlling operation of the pressure device and the valve.

Optionally, the printhead assembly further comprises a pressure sensor for measuring a pressure in the ink reservoir or the ink conduit.

Optionally, the pressure sensor is in communication with the controller, the controller being configured to control the pressure device in response to feedback provided by the pressure sensor.

Optionally, the controller is configured to coordinate a printhead purging/cleaning operation using the pressure device, the pressure sensor and the valve.

Optionally, the controller is configured to coordinate the following steps in response to a request for printhead purging/cleaning:

(i) close the valve;

(ii) pressurize the ink reservoir containing the cleaning liquid using the pressure device;

(iii) monitor a pressure in the ink reservoir or the ink conduit using the pressure sensor; and (iv) open the valve for a predetermined period when a predetermined pressure has been reached, thereby flooding an ink ejection face of the printhead with cleaning liquid.

Optionally, each ink reservoir comprises a pressure-biasing means for biasing a pressure in the reservoir towards a negative pressure.

Optionally, each ink reservoir comprises an ink bag.

In a seventeenth aspect, there is provided a method of cleaning an ink ejection face of an inkjet printhead, the method comprising the steps of:

(i) supplying cleaning liquid to the printhead via an ink conduit in fluid communication with nozzles in the printhead; and (ii) purging the cleaning liquid from the printhead, thereby flooding the face with cleaning liquid.

Optionally, the cleaning liquid is water, a dyeless ink base, an aqueous surfactant solution or an aqueous glycol solution.

Optionally, the printhead is in fluid communication with a plurality of ink reservoirs, at least one of the reservoirs containing the cleaning liquid.

Optionally, the purging comprises positively pressurizing the ink reservoir containing the cleaning liquid.

Optionally, an ink conduit between the printhead and the ink reservoir containing cleaning liquid has a valve.

Optionally, the ink reservoir is pressurized using a pressure device, and operation of the pressure device and the valve is controlled using a controller.

Optionally, the method further comprises measuring a pressure in the ink reservoir or the ink conduit using a pressure sensor.

Optionally, the method further comprises controlling the pressure device in response to feedback provided by the pressure sensor.

Optionally, the method further comprises coordinating a printhead purging/cleaning operation using the pressure device, the pressure sensor and the valve.

Optionally, the method further comprises the step of monitoring a pressure in the ink reservoir or the ink conduit using the pressure sensor, and opening the valve when a predetermined pressure has been reached.

Optionally, each ink reservoir comprises a pressure-biasing means for biasing a pressure in the reservoir towards a negative pressure.

Optionally, each ink reservoir comprises an ink bag.

Optionally, the method further comprises the step of transferring the flooded cleaning liquid onto a transfer surface moving past the face, wherein the transfer surface does not contact the face.

Optionally, the transfer surface is an outer surface of a roller.

Optionally, the transfer surface is moved past the face by rotating the roller.

As used herein, the term "flooding" in connection with printheads is intended to mean deliberately flooding ink across a face of the printhead. It does not include firing ink droplets from nozzles, which may coincidentally cause some degree of flooding.

As used herein, the term "ink" refers to any liquid fed from an ink reservoir to the printhead and ejectable from nozzles in the printhead. The ink may be a traditional cyan, magenta, yellow or black ink. Alternatively, the ink may be an infrared ink, Alternatively, the ink may be a cleaning liquid (e.g. water, dyeless ink base, surfactant solution, glycol solution etc.) which is not used for printing, but instead used specifically for cleaning the ink ejection face of the printhead.

The maintenance systems, ink supply systems and methods of the present application advantageously allow particulates to be removed from a printhead, whilst avoiding contact of the printhead with an external cleaning device. Hence, unlike prior art squeegee-cleaning methods, the unique cleaning action of the present invention does not impart any shear forces across the printhead and does not damage sensitive nozzle structures. Moreover, the transfer surface in the present invention, which does not come into contact with the printhead, is not damaged by the printhead and can therefore be used repeatedly whilst maintaining optimal cleaning action.

A further advantage of the maintenance system is that it has a simple design, which can be manufactured at low cost and typically consumes very little power. The suction devices of the prior art require external pumps, which add significantly to the cost and power consumption of prior art printers.

A further advantage of the maintenance system and method is that it consumes relatively little ink compared to prior art suction devices.

BRIEF DESCRIPTION OF THE DRAWINGS

Specific forms of the present invention will be now be described in detail, with reference to the following drawings, in which.

DETAILED DESCRIPTION OF SPECIFIC EMBODIMENTS

Printhead Maintenance System Comprising Maintenance Roller

Figure 1:
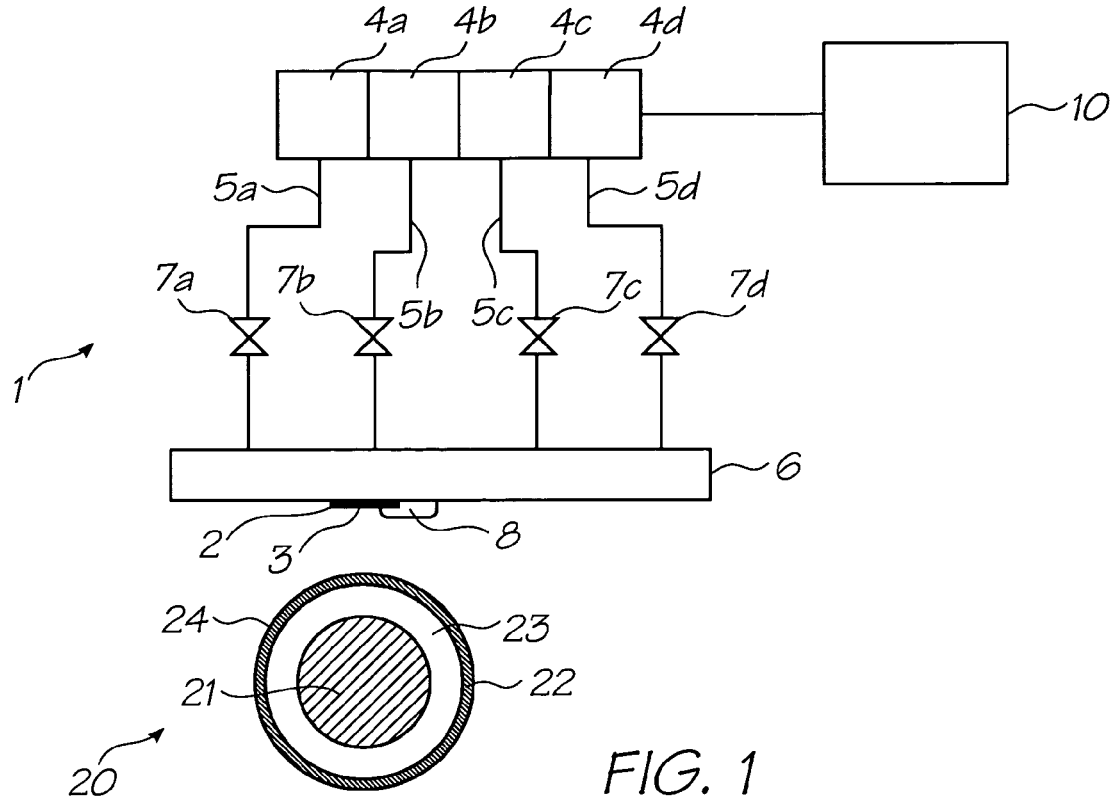
FIG. 1 is a schematic view of a printhead maintenance system.

Referring to FIG. 1, there is shown a printhead maintenance system 1 for maintaining a printhead 2 in an operable condition. Throughout the lifetime of the printhead 2, nozzles may become blocked with a viscous plug of ink during periods when the printhead is idle. This is a phenomenon known in the art as decap and invariably leads to the sub-optimal printing.

Alternatively, paper dust may build up on the ink ejection face 3 of the printhead 2, leading to misdirected ink droplets from partially obscured nozzles or even blocked nozzles. The printhead maintenance system 1 is configured to maintain the printhead in an optimal operating condition by unblocking any blocked nozzles and/or removing particulates from the ink ejection face 3.

The printhead maintenance system 1 comprises a plurality of ink reservoirs 4*a*, 4*b*, 4*c* and 4*d*, each supplying ink to the printhead 2 via respective ink conduits 5*a*, 5*b*, 5*c* and 5*d*. The printhead 2 is attached to an ink manifold 6, which directs ink supplied by the ink conduits 5*a*, 5*b*, 5*c* and 5*d* into a backside of the printhead. A plurality of solenoid valves 7*a*, 7*b*, 7*c* and 7*d* are positioned in respective ink conduits 5*a*, 5*b*, 5*c*, 5*d*. The valves may be opened and closed to control a flow of ink to the printhead 2.

The ink reservoirs 4*a*, 4*b*, 4*c* and 4*d* communicate with a pressure system 10, which is used to pressurize the ink reservoirs. The pressure system 10 may be configured to allow independent control of the pressure inside each ink reservoir independently. Alternatively, the pressure system may be configured to control the pressure inside the plurality of ink reservoirs together.

Since the pressure system 10 positively pressurizes the ink reservoirs 4*a*, 4*b*, 4*c* and 4*d*, it can be used to purge ink out of nozzles in the printhead 2 and onto the ejection face 3. Hence, the pressure system 10, in cooperation with the ink reservoirs 4 and ink conduits 5, defines a face flooding system.

Still referring to FIG. 1, there is also shown a first transfer roller 20 comprising a stainless steel core roller 21 having an outer transfer film 22. A resiliently deformable intermediate layer 23 is sandwiched between the transfer film 22 and the core roller 21. The first transfer roller 20 is coextensive with the printhead 2, which is a pagewidth inkjet printhead. Hence, the metal roller 21 provides rigidity in the first transfer roller 20 along its entire length.

An outer surface of the transfer film 22 defines a transfer surface 24, which receives flooded ink during printhead maintenance operations. The intermediate layer 23 provides resilient support for the transfer film 22, thereby allowing resilient engagement between the transfer surface 24 and an ink removal system (not shown in FIG. 1).

The first transfer roller 20 is moveable into a printhead maintenance position in which the transfer surface 24 is positioned in a transfer zone. When positioned in the transfer zone, the transfer surface 24 is adjacent to but not in contact with the ink ejection face 3 of the printhead 2. The transfer surface 24 may or may not be in contact with a sealing member 8 bonded along an edge portion of the printhead 2 when it is positioned in the transfer zone. As shown in FIG. 1, the first transfer roller 24 is in an idle position with the transfer surface 24 being positioned distal from the printhead 2.

The first transfer roller is also rotatable about its longitudinal axis so as to allow the transfer surface 24 to be fed through the transfer zone and away from the printhead 2. Rotation of the first transfer roller 20 is provided by means of a transport mechanism (not shown in FIG. 1), operatively connected to the core roller 21. The transport mechanism typically comprises a simple motor operatively connected to the core roller 21 via a gear mechanism.

Figure 2:
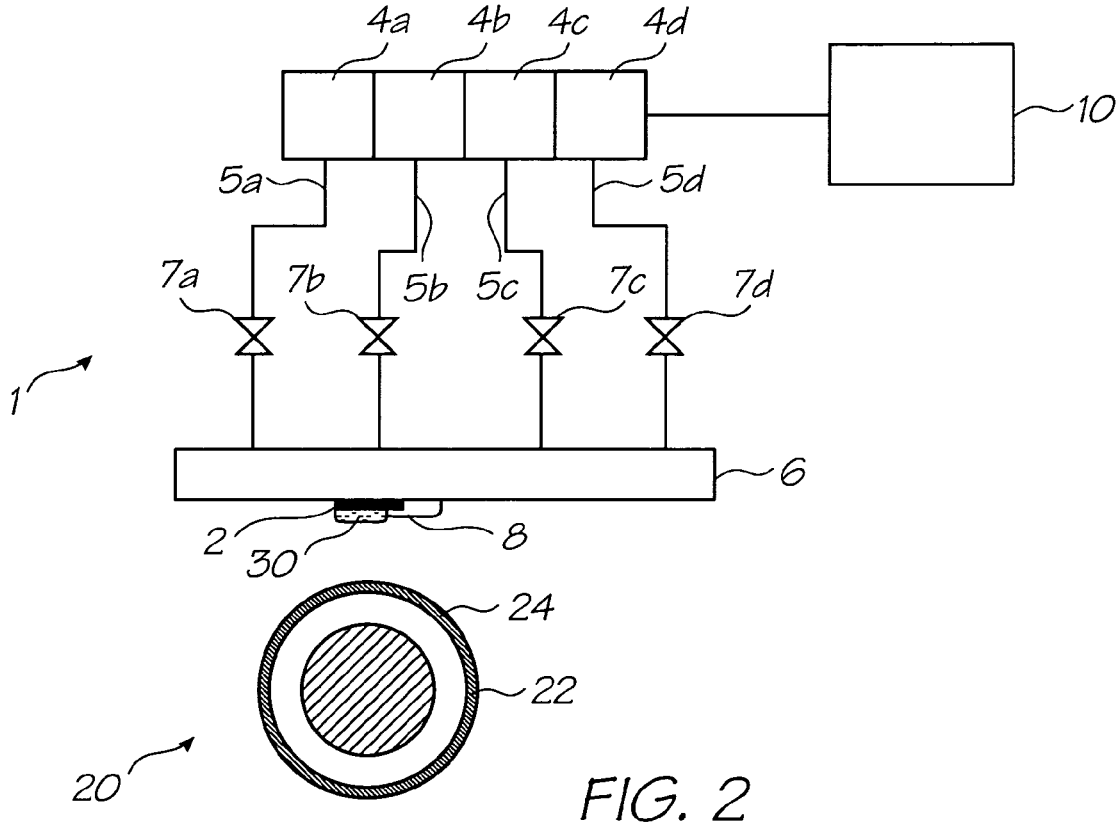
FIG. 2 is a schematic view of the printhead maintenance system shown in FIG. 1 with ink flooded across the printhead.

A method of maintaining the printhead 2 in an operable condition will now be described with reference to FIGS. 1 to 5. Initially, as shown in FIG. 1, the first transfer roller 20 is in an idle position, with the transfer surface 24 distal from the printhead 2. With the first transfer roller 20 still in its idle position, the valves 7*a*, 7*b*, 7*c* and 7*d* are closed and the pressure system 10 is actuated to exert a positive pressure on the ink reservoirs 4*a*, 4*b*, 4*c* and 4*d*. Then, once a predetermined pressure has been reached inside the ink reservoirs (typically about 30 kPa), the valves 7*a*, 7*b*, 7*c* and 7*d* are opened for a brief period (typically about 150 ms). Opening of the valves 7*a*, 7*b*, 7*c* and 7*d* causes ink 30 to purge from nozzles in the printhead 2 onto the ink ejection face 3 (FIG. 2). This purging unblocks any decapped nozzles in the printhead 2 containing a plug of viscous ink. Once purging is complete and the face 3 is flooded with ink 30, the positive pressure applied by the pressure system 10 is released.

Figure 3:
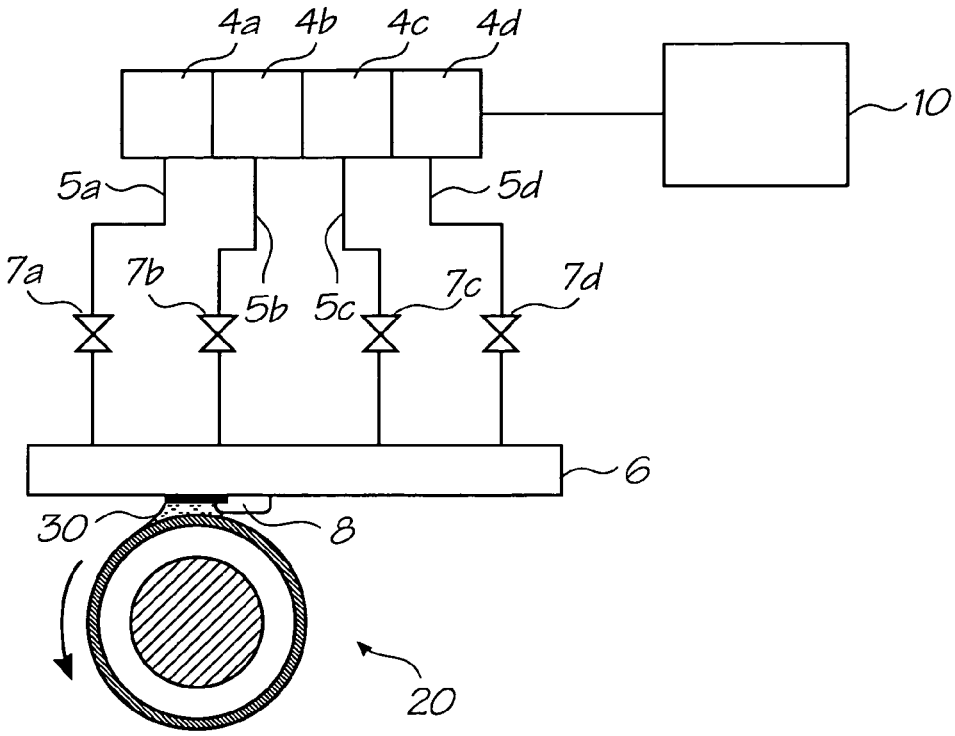
FIG. 3 is a schematic view of the printhead maintenance system shown in FIG. 2 with the transfer surface positioned in the transfer zone.

Turning now to FIG. 3, the first transfer roller 20 is then moved into the printhead maintenance position, in which the transfer surface 24 is positioned in a transfer zone adjacent the ink ejection face 3. Typically, a minimum distance between the transfer zone and the ink ejection face 3 is less than about 2 mm, or less than about 1 mm, or less than about 0.5 mm.

Figure 4:
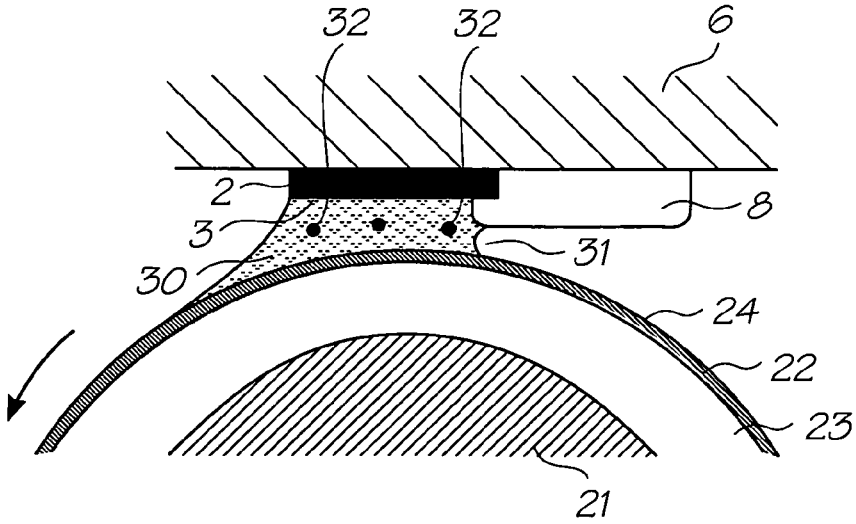
FIG. 4 is a enlarged view of the transfer zone in FIG. 3.

As shown more clearly in FIG. 4, the transfer surface 24, when positioned in the transfer zone, forms a fluidic seal with the sealing member 8 by virtue of a meniscus 31 pinning between the two surfaces.

The flooded ink 30 contains particulates 32 of paper dust, which have lifted from the ink ejection face 3 by flotation. The flooded ink 30, including its dispersed particulates 32, is then transferred onto the transfer surface 24 by rotating the first transfer roller 20, thereby feeding the transfer surface through the transfer zone and away from the printhead 2. The transfer film 22 may be a plastics film comprised of polyethylene, polypropylene, polycarbonates, polyesters or polyacrylates. Typically, the transfer film is comprised of a wetting or hydrophilic material to maximize transfer of ink 30 onto the transfer surface 24. Accordingly, the transfer film 22 may be comprised of a hydrophilic polymer or, alternatively, the transfer surface 24 may be coated with a hydrophilic coating (e.g. silica particle coating) to impart wetting properties.

As shown in FIGS. 3 and 4, the first transfer roller is rotated anticlockwise so that the transfer surface 24 transports flooded ink 30 away from the side of the printhead 2 not having the sealing member 8 bonded thereto. This arrangement maximizes the efficacy of ink transfer.

Figure 5:
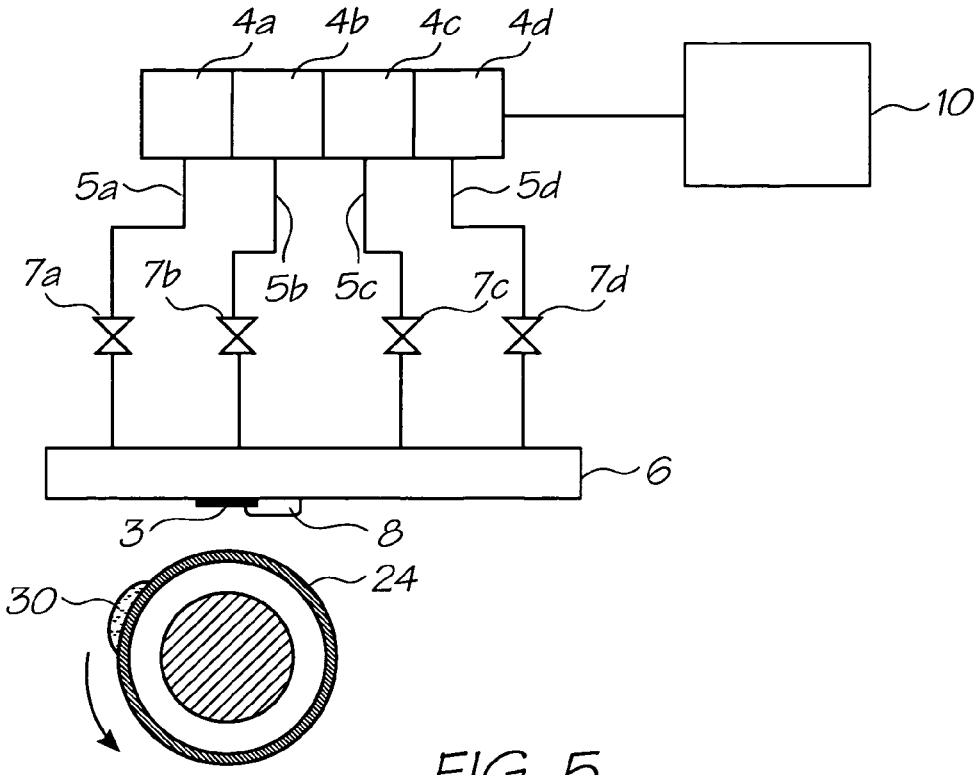
FIG. 5 is a section through line A-A of the printhead maintenance station shown in FIG. 7.

Referring now to FIG. 5, there is shown the printhead maintenance system 1 after completion of a printhead maintenance operation. The transfer surface 24 has collected the flooded ink 30, and the ink ejection face 3 is clean, free of any particulates and has unblocked nozzles.

The ink 30 collected on the transfer surface 24 is removed by an ink removal system, which is not shown in FIGS. 1 to 5, but which will now be described in detail with reference to FIGS. 6 to 9.

Figure 6:
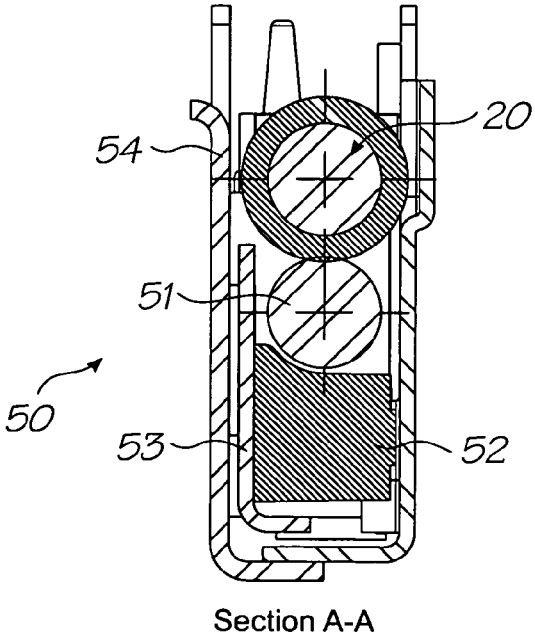
FIG. 6 a section through line B-B of the printhead maintenance station shown in FIG. 7.

Referring initially to FIG. 6, a maintenance station 50 comprises a first transfer roller 20, as described above, engaged with a stainless steel second transfer roller 51. An absorbent cleaning pad 52 is in contact with the second transfer roller. The second transfer roller 51 and cleaning pad 52 together form the ink removal system. Ink is received from the first transfer roller 20 and deposited onto the cleaning pad 52 via the highly wetting surface of the second transfer roller 51.

It is, of course, possible for the second transfer roller 51 to be absent in the ink removal system, and for the cleaning pad 52 to be in direct contact with the first transfer roller 20. Such an arrangement is clearly contemplated within the scope of the present invention. However, the use of a metal second transfer roller 51 has several advantages. Firstly, metals have highly wetting surfaces (with contact angles approaching 0°), ensuring complete transfer of ink from the first transfer roller 20 onto the second transfer roller 51. Secondly, the metal second transfer roller 51, unlike a directly contacted cleaning pad, does not generate high frictional forces on the transfer surface 24. The metal second transfer roller 51 can slip relatively easily past the cleaning pad 52, which reduces the torque requirements of a motor (not shown) driving the rollers and preserves the lifetime of the transfer surface 24. Thirdly, the rigidity of the second transfer roller 51 provides support for the first transfer roller 20 and minimizes any bowing. This is especially important for pagewidth printheads and their corresponding pagewidth maintenance stations.

Figure 9:
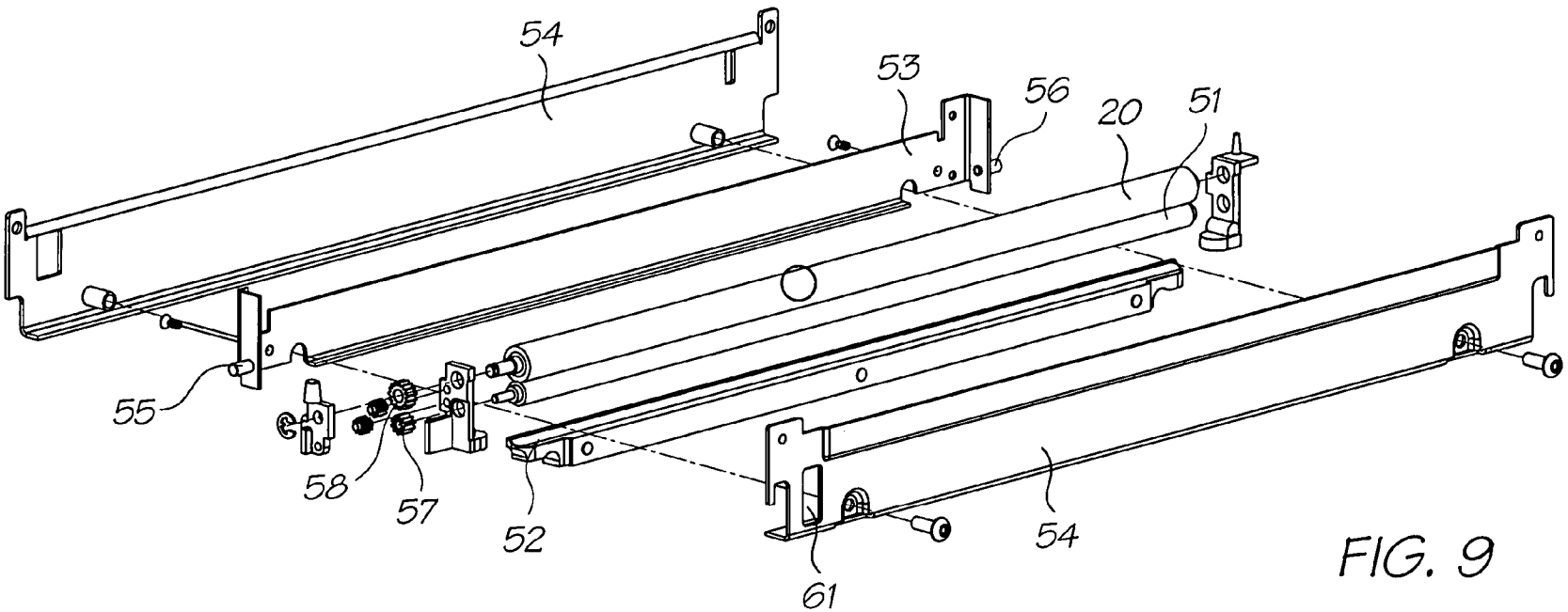
FIG. 9 is an exploded perspective view of the printhead maintenance station shown in FIG. 8.

As shown more clearly in FIG. 9, the first transfer roller 20, second transfer roller 51 and cleaning pad 52 are all mounted on a moveable chassis 53. The chassis 53 is moveable perpendicularly with respect to the ink ejection face 3, such that the transfer surface 24 can be moved into and out of the transfer zone. The chassis 53, together with all its associated components, is contained in a housing 54. The chassis 53 is slidably moveable relative to the housing 54.

The chassis 53 further comprises engagement formations in the form of lugs 55 and 56, positioned at respective ends of the chassis. These lugs 55 and 56 are provided to slidably move the chassis 53 upwards and downwards relative to the printhead 2 by means of an engagement mechanism (not shown). Typically the engagement mechanism will comprise a pair of arms engaged with the lugs 55 and 56, and arranged so that rotational movement of the arms imparts a sliding movement of the chassis 53 via a camming engagement with the lugs.

Figure 7:
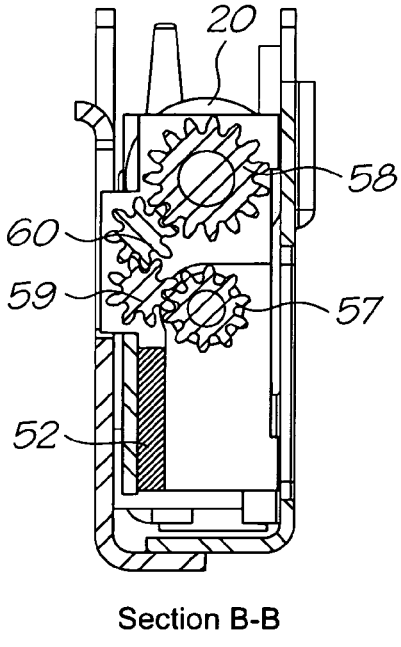
Figure 8:
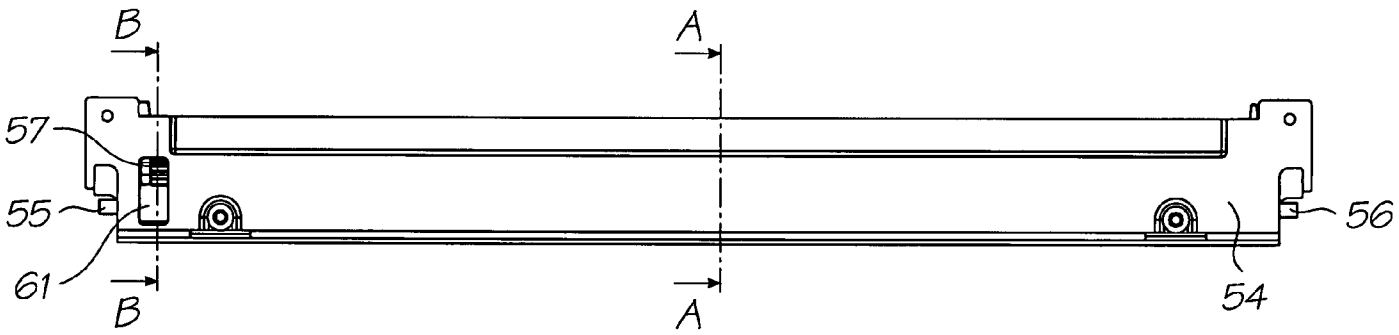
FIG. 8 is a front view of a printhead maintenance station.

Referring now to FIG. 7, it can be seen that rotation of the first and second transfer rollers 20 and 51 is via a suitable gear arrangement. A main drive gear 57, operatively mounted at one end of the second transfer roller 51, drives a subsidiary drive gear 58, operatively mounted at one end of the first transfer roller 20, via intermeshing idler gears 59 and 60. A flipper gear wheel (not shown), driven by a drive motor (not shown) can intermesh with the main drive gear 58 through a slot 61 in the housing 54 (see FIGS. 8 and 9). Hence, the gear arrangement comprising the main drive gear 57, subsidiary drive gear 58 and idler gears 59 and 60 forms part of a transport mechanism, which rotates the first and second transfer rollers 20 and 51 synchronously, thereby feeding the transfer surface 24 through the transfer zone.

Printhead Maintenance Using Disposable Sheet

An alternative form of the printhead maintenance system 1 described above employs a disposable sheet for removing the flooded ink 30 from the ink ejection face 3.

Figure 10:
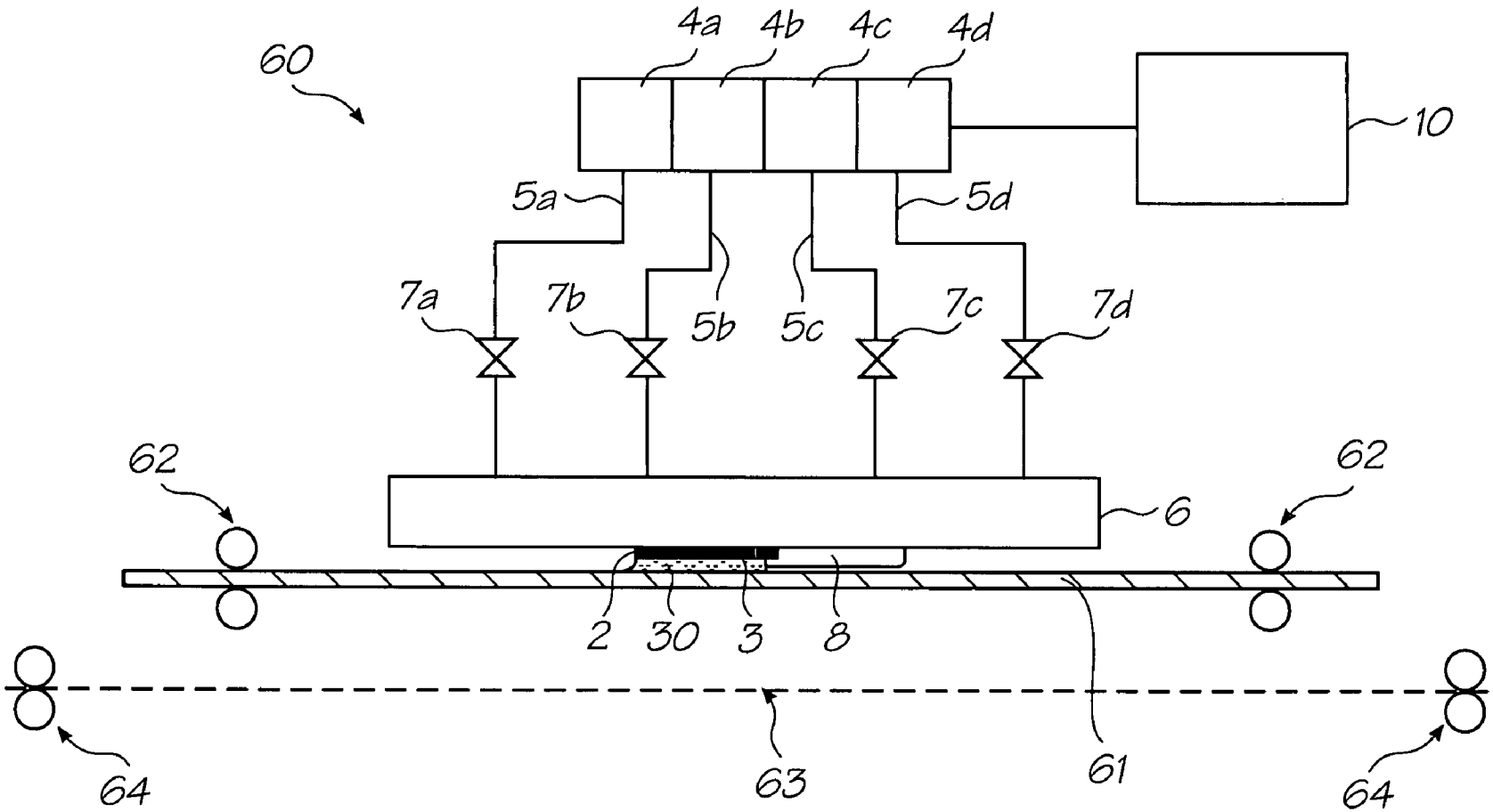
FIG. 10 is a schematic view of an alternative printhead maintenance system.

Referring to FIG. 10, there is shown a printhead maintenance system 60 comprising an ink supply system suitable for purging, as described above. The ink supply system comprises ink reservoirs 4*a*, 4*b*, 4*c* and 4*d*, pressure device 10, ink conduits 5*a*, 5*b*, 5*c* and 5*d*, valves 7*a*, 7*b*, 7*c* and 7*d*, ink manifold 6 and printhead 2 having ink ejection face 3.

However, instead of the transfer roller 20, a disposable sheet 61 is used to remove flooded ink 30 from the ink ejection face 3 by wicking the ink onto the sheet. The disposable sheet 61 is typically a one-time use sheet of paper having a high absorbency. The sheet 61 is fed through a maintenance zone adjacent to and spaced apart from the face 3 by a sheet feed arrangement 62.

The sheet 61 follows a different path from normal print media used for printing. Print media (not shown) are fed through a print zone 63 by a media feed arrangement 64. As shown in FIG. 10, the print zone 63 is further from the face 3 than the maintenance zone through which the disposable sheet 61 is fed.

The sheet feed arrangement 62 may be configured for either manual or automated feeding of the sheet 61. Typically, once the sheet 61 has collected the flooded ink 30, it is expelled through a slot in a printer by the sheet feed arrangement 62. The user can then pull the sheet 61 from the printer and dispose of it accordingly.

Purging and sheet feeding may be coordinated by a controller in an analogous fashion to that described above in connection with printhead maintenance system 1.

Purging Using Compression Mechanism

In the printhead maintenance systems 1 and 60 described above, a pressure device 10 was used to positively pressurize the ink reservoirs 4*a*, 4*b*, 4*c* and 4*d*, which resulted in purging of the printhead 2. An ink supply system, incorporating a specific form of pressure device and suitable for use in the printhead maintenance system 1, will now be described in detail.

Figure 11A:
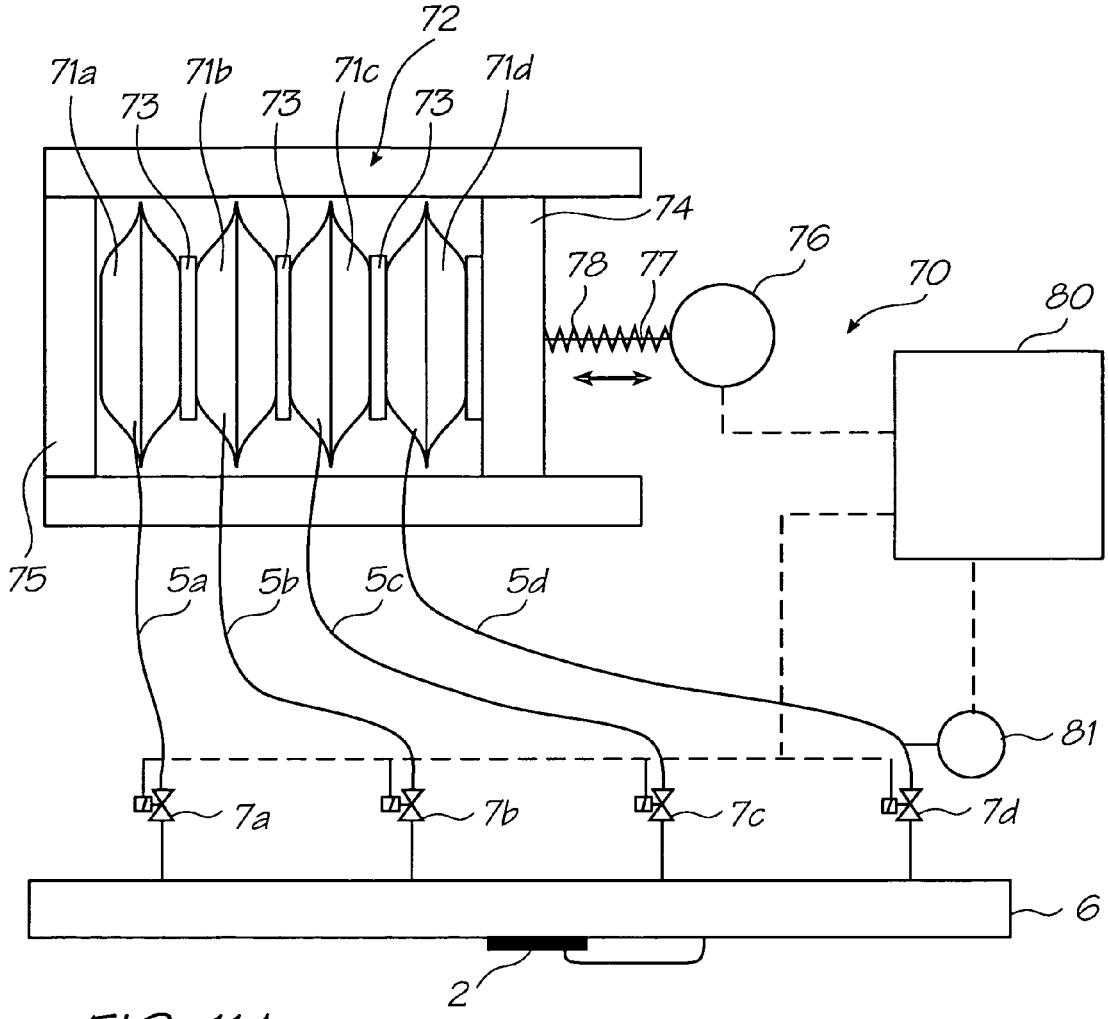
FIG. 11A is a schematic view of an ink supply system with compression mechanism.

Referring to FIG. 11A, there is shown an ink supply system 70 for the printhead 2. The ink reservoirs takes the form of compressible ink bags 71*a*, 71*b*, 71*c* and 71*d*, which are contained in a reservoir housing 72 and separated from each other by spacer plates 73. The ink bags 71*a*, 71*b*, 71*c* and 71*d* supply ink to the ink manifold 6 via respective ink conduits 5*a*, 5*b*, 5*c* and 5*d*. Each ink conduit has a respective solenoid valve 7*a*, 7*b*, 7*c* and 7*d* for controlling a supply of ink into the manifold 6 and the printhead 2.

One wall of the reservoir housing 72 is slidably moveable relative to the other walls and takes the form of a compression member or compression plate 74. Sliding movement of the compression plate 74 urges it against a wall of one of the ink bags 71*d*. Since all the ink bags 71*a*, 71*b*, 71*c* and 71*d* are intimately arranged inside the housing, a pressure applied by the compression plate 74 on the ink bag 71*d* is distributed into all the ink bags 71*a*, 71*b*, 71*c* and 71*d* via an opposite wall of the housing which acts as a reaction plate 75. The applied pressure is distributed evenly throughout the ink bags by the spacer plates 73. Hence, each ink bag is maintained at the same positive pressure when compressed by the compression plate 74.

The compression plate 74 is connected to a motor/cam device 76 via a rod 77. Actuation of the motor/cam device 76 results in sliding movement of the compression plate 74 towards the reaction plate 75 and compression of the ink bags 71*a*, 71*b*, 71*c* and 71*d*. A spring 78 interconnecting the compression plate 74 and motor/cam device 76 biases the compression plate 74 away from the reaction plate 75 so that the ink supply system 70 is biased into a configuration where no positive pressure is applied to the ink bags.

Figure 11B:
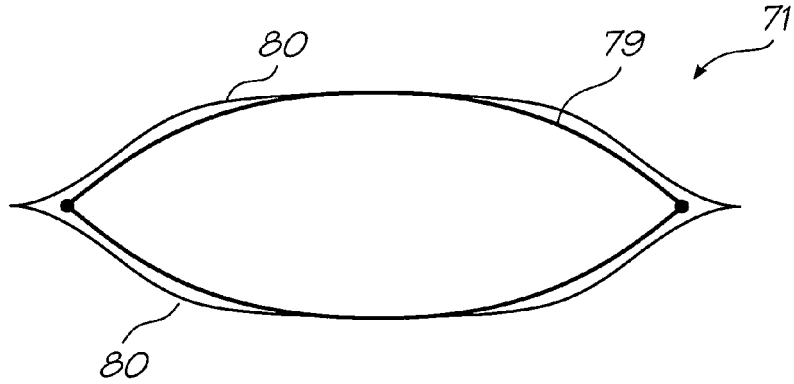
FIG. 11B is a longitudinal section through an ink bag for use in the ink supply system shown in FIG. 11.

Referring briefly to FIG. 11B, each ink bag 71 contains a leaf spring 79, which acts against the walls 80 of the bag and biases the ink bag into a configuration which maintains a negative pressure inside the bag. This negative pressure is required during normal printing to prevent ink from flooding spontaneously out of nozzles and onto the ink ejection face 3. Actuation of the motor/cam device 76 forces the leaf spring 79 in each ink bag to compress, generating positive pressure in each ink bag. When the motor/cam device 76 is de-actuated, the leaf spring 79 in each ink bag returns each ink bag to an expanded configuration, and a negative pressure inside each bag is resumed.

A controller 80 communicates with and controls operation of the motor/cam device 76 and the solenoid valves 7*a*, 7*b*, 7*c* and 7*d*. In addition, a pressure sensor 81 measures a pressure a pressure in the ink conduit 5*d* and communicates this information back to the controller 80. Since each ink bag and each ink conduit is at the same pressure in the arrangement described above, only one pressure sensor 81 is required.

The controller 80 controls operation of the ink supply system 70 and, in particular, coordinates opening and closing of the valves 7*a*, 7*b*, 7*c* and 7*d* with actuation of the motor/cam device 76 when printhead purging is required. The controller 80 may also be used to control operation of the printhead maintenance station 50, after the printhead 2 has been purged.

In a typical printhead purging sequence, the controller 80 receives a request for purging and initially closes the solenoid valves 7*a*, 7*b*, 7*c* and 7*d*. Once the valves are closed, the motor/cam device 76 is actuated, which results in compression of the ink bags 71*a*, 71*b*, 71*c* and 71*a*, and a build up of positive pressure in the ink bags and the ink conduits 5*a*, 5*b*, 5*c* and 5*d*. This pressure is monitored using the pressure sensor 81, which provides feedback to the controller 80. When a predetermined pressure (e.g. 30 kPa) has been reached, the solenoid valves 7*a*, 7*b*, 7*c* and 7*d* are opened for a brief period (e.g. 150 ms), which purges the printhead 2 and floods the ink ejection face 3 with ink.

At this point, the maintenance station 50 may be actuated to clean the ink ejection face 3 in the manner described above. Several purge/maintenance cycles may be required depending on the severity of nozzle blocking or the amount of paper dust built up on the ink ejection face 3.

After purging and cleaning, the motor/cam device 76 is de-actuated, which returns the ink bags 71*a*, 71*b*, 71*c* and 71*d* to a negative pressure by the action of the spring 78 and respective leaf springs 79 inside each ink bag. Again, the pressure in the ink conduit 5*d* is monitored during this phase. Finally, the controller 80 re-opens the solenoid valves 7*a*, 7*b*, 7*c* and 7*d* once a predetermined negative pressure suitable for printing has been reached.

Purging Using Pressure Chamber

An alternative ink supply system, incorporating an alternative form of pressure device and suitable for use in the printhead maintenance systems 1 and 60, will now be described in detail.

Figure 12:
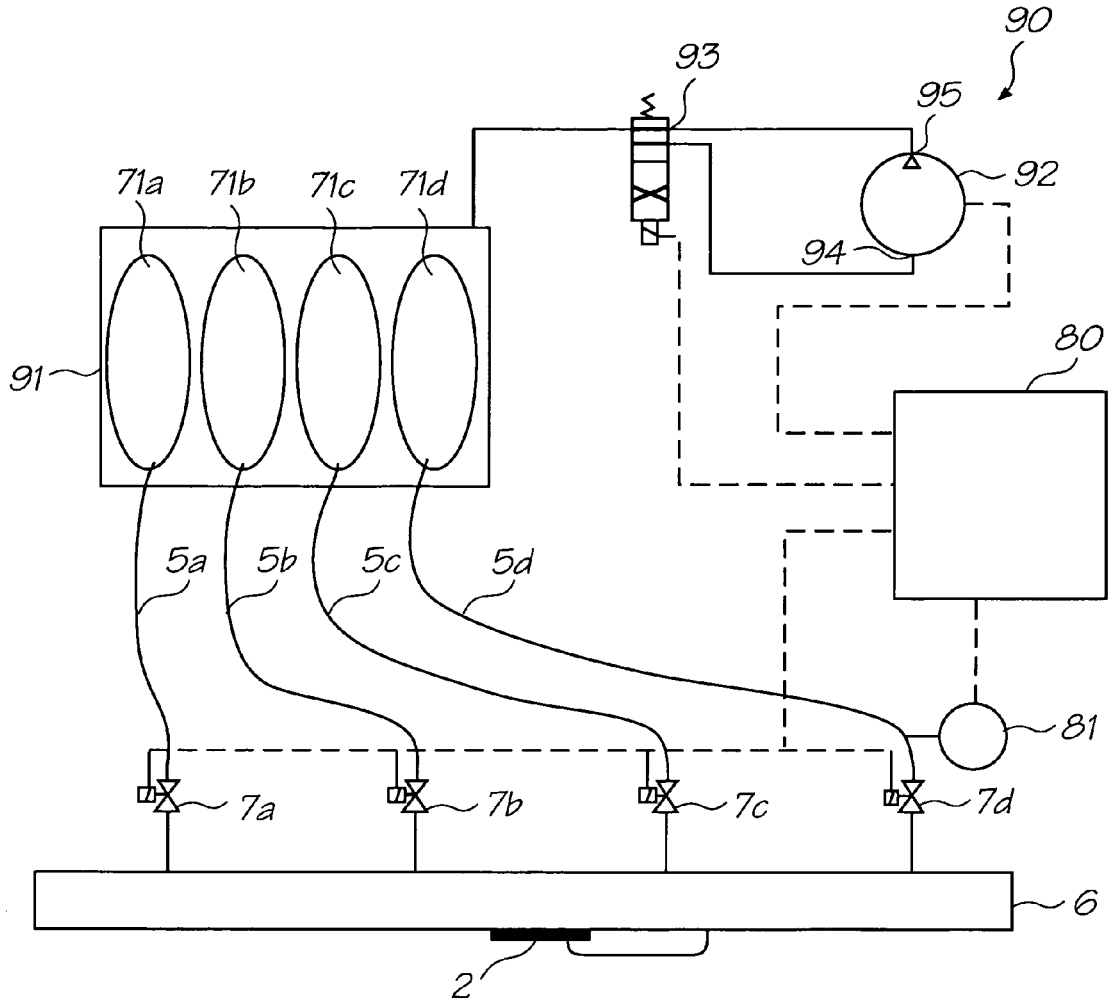
FIG. 12 is a schematic view of an ink supply system with air compressor in a positively-pressurizing configuration.

Referring initially to FIG. 12, there is shown an ink supply system 90 for supplying ink to the printhead 2. Ink reservoirs take the form of compressible ink bags 71*a*, 71*b*, 71*c* and 71*d*, which are contained in a pressurizable chamber 91. The ink bags 71*a*, 71*b*, 71*c* and 71*d* supply ink to the ink manifold 6 via respective ink conduits 5*a*, 5*b*, 5*c* and 5*d*. Each ink conduit has a respective solenoid valve 7*a*, 7*b*, 7*c* and 7*d* for controlling a supply of ink into the manifold 6 and the printhead 2.

The chamber 91 is in fluid communication with an air compressor 92 via a switchable solenoid valve 93. The air compressor 93 and solenoid valve 93 are connected to the controller 80, which controls actuation of the compressor and the configuration of the valve 93 in response to feedback supplied by the pressure sensor 81. The controller 80 communicates with the valves 7*a*, 7*b*, 7*c* and 7*d* and pressure sensor 81 analogously to the ink supply system 70 described above.

Figure 13:
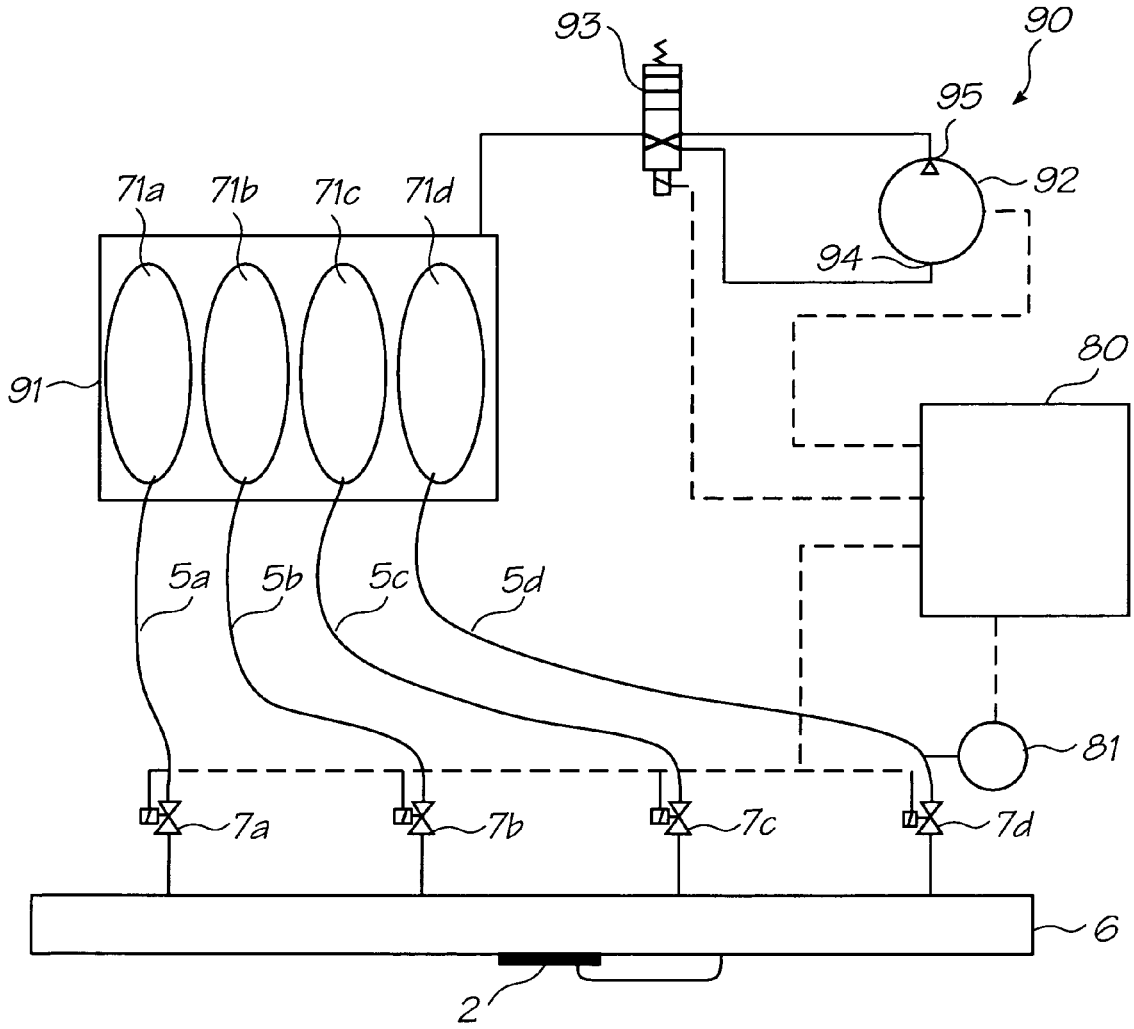
FIG. 13 is a schematic view of the ink supply system shown in FIG. 12 in a negatively-pressurizing configuration.

The solenoid valve 93 may be switched between two positions, which configure the ink supply system 90 into either a positively-pressurizing configuration (FIG. 12) or a negatively-pressurizing configuration (FIG. 13).

As shown FIG. 12, an air inlet 94 of the air compressor 92 is open to atmosphere, while an air outlet 95 is in fluid communication with the chamber 91. Hence, actuation of the compressor 92 in this configuration results in the chamber 91 becoming positively pressurized.

As shown in FIG. 13, the air inlet 94 of the air compressor 92 is in fluid communication with the chamber 91, while the air outlet 95 is open to atmosphere. Hence, actuation of the compressor 92 in this configuration results in the chamber 91 becoming negatively pressurized. An advantage of this ink supply system 90 is that not only can the ink bags 71*a*, 71*b*, 71*c* and 71*d* be positively pressurized for purging, but a controlled negative pressure can also be imparted onto the ink bags for normal printing without requiring any special design of the ink bags.

Hitherto, the design of ink bags (or other ink reservoirs) typically required a negative pressure-biasing means, such as the internal leaf spring 79 shown in FIG. 11, for imparting a negative pressure in the ink bag during printing. This mechanical means may be inaccurate and cannot react dynamically to environmental changes, which affect pressure in the ink supply system (e.g. temperature, print speed etc). However, with the active pressure control provided by the chamber 91, air compressor 92 and solenoid valve 93, it will be appreciated that an optimum ink pressure for any printing conditions can be achieved using feedback to the controller 80 provided by pressure sensor 81.

A typical purging operation may be performed analogously to that described above for the ink supply system 70, but using the air compressor 92 in a positively-pressurizing configuration (FIG. 12) in place of the compression mechanism.

Ink Supply System with Hammer Mechanism for Variable Purge Volume/Pressure

An alternative ink supply system for purging a printhead will now be described. This alternative ink supply system is suitable for use in, for example, the printhead maintenance systems 1 and 60 described above or any system/method of printhead maintenance requiring face flooding.

Figure 14:
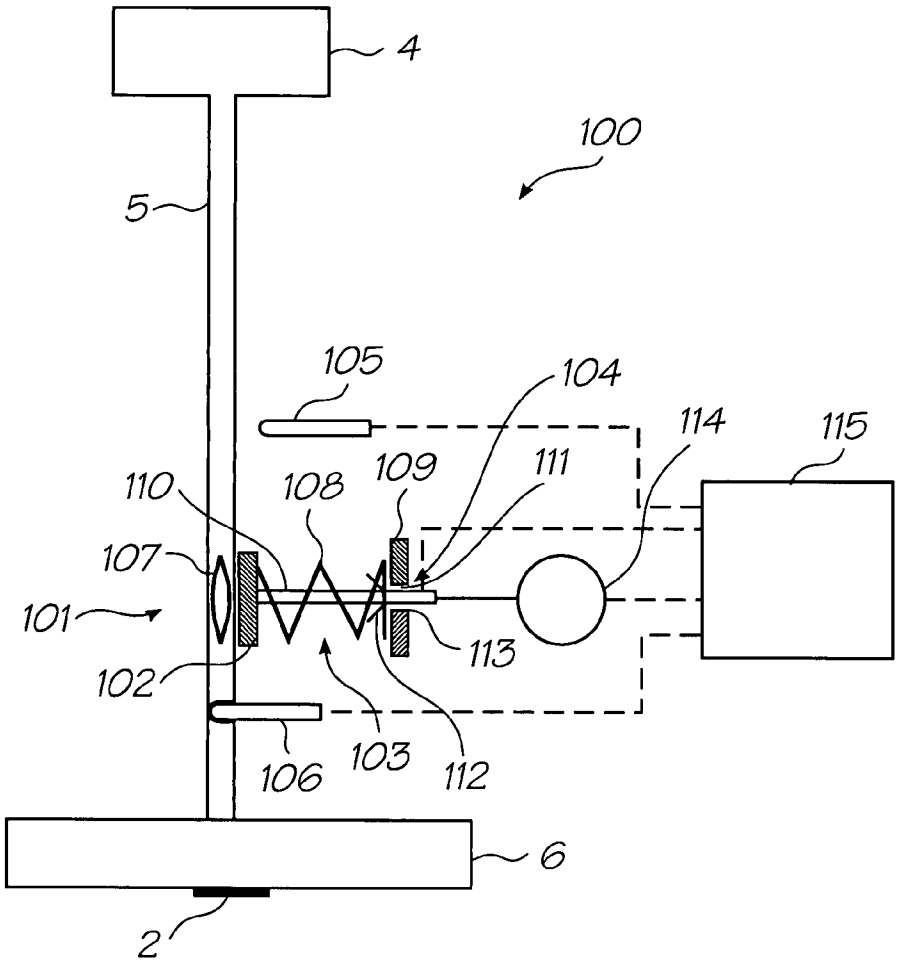
FIG. 14 is a schematic view of an ink supply system with hammer mechanism.

Referring to FIG. 14, there is shown an ink supply system 100 for supplying ink to a printhead 2. An ink reservoir 4 stores ink and supplies it to the ink manifold 6 via an ink conduit 5. The printhead 2 receives ink from the ink manifold 6 to which it is attached.

A hammer mechanism 101 is positioned adjacent the ink conduit 5. The hammer mechanism may be any mechanism suitable for rapidly compressing the ink conduit 5. The hammer mechanism 101 comprises a hammer head 102, a spring-loading mechanism 103 and a release mechanism 104. Hence, the hammer mechanism 101 is configured for compressing part of the ink conduit 5, and purging ink from the ink conduit and out of the printhead 2.

A first pinch valve 105 is positioned upstream of the hammer mechanism 101 on an ink reservoir side, and a second pinch valve 106 is positioned downstream of the hammer mechanism on a printhead side. The first and second pinch valves 105 and 106 may be independently engaged to stop a flow of ink through the conduit 5. As shown in FIG. 14, the second pinch valve 106 is engaged with the ink conduit 5, while the first pinch valve 105 is disengaged from the ink conduit.

It will of course be appreciated that an ink supply system 100 may comprise a plurality of ink reservoirs, each having a respective ink conduit for supplying ink to the printhead 2. Likewise, each ink conduit may have a respective hammer mechanism and respective pinch valves for purging ink from the printhead 2. However, for the sake of clarity, only one such arrangement will be described here.

Referring again to FIG. 14, a conduit expander in the form of a leaf spring 107 is positioned in the ink conduit 5 adjacent the hammer head 102. The leaf spring 107 biases part of the ink conduit 5 into an expanded configuration. As shown in FIG. 14, the leaf spring 107 is held in a contracted configuration by virtue of the hammer head 102 urging against a wall of the ink conduit 5.

The spring-loading mechanism 103 comprises a spring 108 which interconnects the hammer head 102 and a fixed abutment plate 109 having an opening 111. A shaft 110, fixed to the hammer head 102, is received longitudinally through the spring 108 and through the opening 111 in the fixed abutment plate 109. Hence, compression of the spring 108 results in sliding longitudinal movement of the shaft 110 through the opening 111. A resilient detent 112 is positioned on the shaft 110. The resilient detents 112 are configured to engage with a rim 113 of the opening 111 once they have passed through the opening, thereby allowing priming of the hammer head 102.

Sliding longitudinal movement of the shaft 110 is by virtue of a motor/cam device 114 engaged with the shaft. Actuation of the motor/cam device 114 retracts the shaft 110 away from the ink conduit, and locks the hammer mechanism 101 into a primed configuration by virtue of the detent 112 abutting the rim 113.

Figure 15:
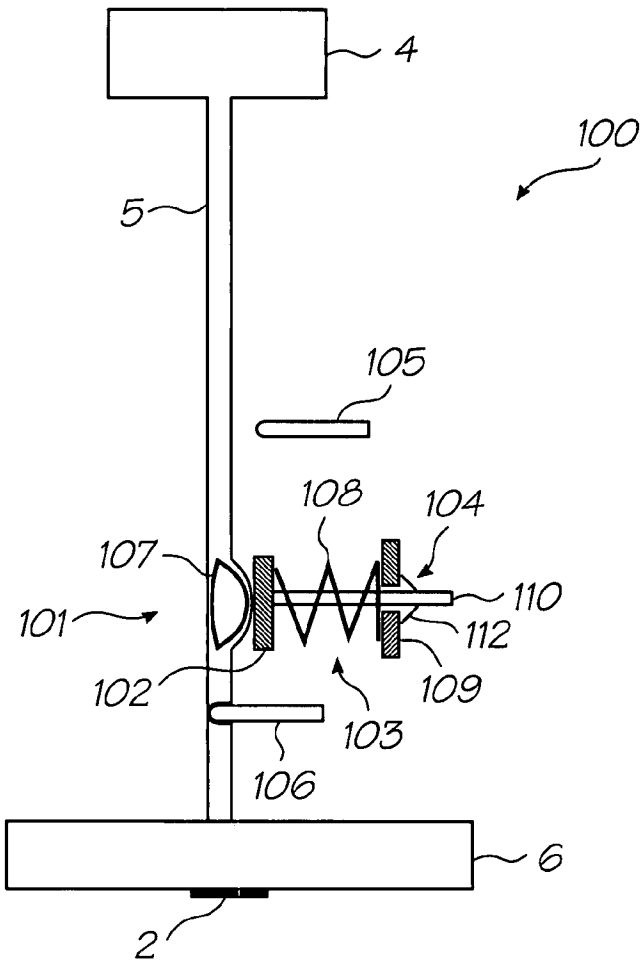
FIG. 15 is a schematic view of the ink supply system shown in FIG. 14 with the hammer mechanism primed.

Referring now to FIG. 15, there is shown the hammer mechanism 101 in a primed configuration with the hammer head 102 primed for compressing the ink conduit 5. With the hammer head 102 retracted, the bias of the leaf spring 107 causes part of the ink conduit 5 to expand. The expanded volume of the ink conduit 5 is determined by the amount the hammer head 102 is retracted by the spring loading mechanism 103.

Figure 17:
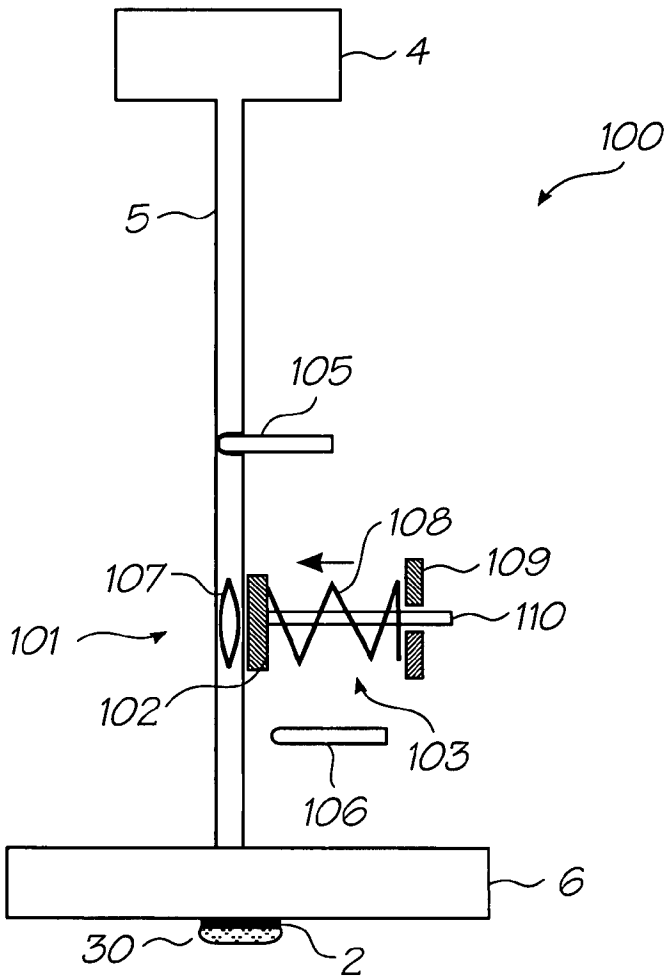
FIG. 17 is a schematic view of the ink supply system shown in FIG. 14 immediately after purging.

The spring-loading mechanism 103 also comprises a release mechanism 104, which allows the primed hammer head 102 to release and hammer into the ink conduit 5. This hammer action causes rapid compression of the expanded part of the ink conduit and, hence, ink to purge from the printhead 2, as shown in FIG. 17. The release mechanism 103 retracts the detents 112 inside the shaft 110 allowing the shaft to slide freely through the opening 111 with the force of the primed spring 108. FIG. 17 shows the detents 112 retracted inside the shaft 110 and the hammer head 102 compressing part of the ink conduit 5.

Referring again to FIG. 14, a controller 115 controls and coordinates operation of the hammer mechanism 101 (including the spring-loading mechanism 103 and release mechanism 104), and the pinch valves 105 and 106. With suitable sequencing of the hammer mechanism 101 and pinch valves 105 and 106, the controller 115 may be used to coordinate a printhead purge.

A typical printhead purge sequence will now be described in detail with reference to FIGS. 14 to 18. For the sake of clarity, the controller 113 and motor/cam device 114 have been removed from FIGS. 15 to 18.

Figure 18:
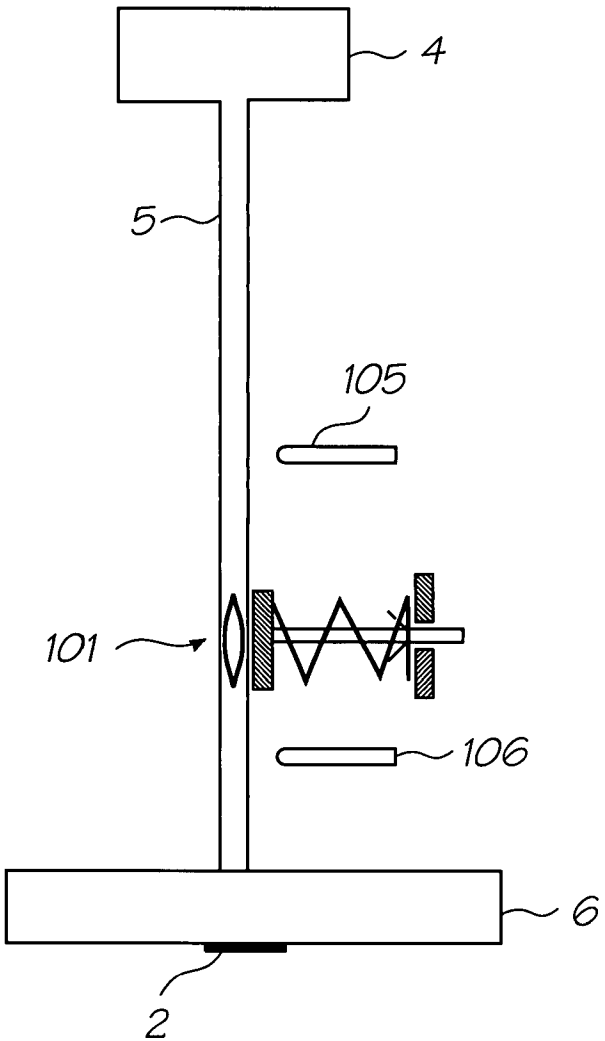
FIG. 18 is a schematic view of the ink supply system shown in FIG. 14 in a normal printing configuration.

During normal printing, the two pinch valves 105 and 106 are open and the hammer mechanism 101 is at its resting position, as shown in FIG. 18. During transport or idle periods, the two pinch valves will typically both be closed. In a first step of printhead purging, the ink supply system 100 is configured such that the first pinch valve 105 is open and the second pinch valve 106 is closed, as shown in FIG. 14. This may require either opening of the first pinch valve 105 or closing of the second pinch valve 106, depending on the initial configuration of the ink supply system 100.

In a second step, actuation of the motor/cam device 114 retracts the hammer head 102 into a primed position, as shown in FIG. 15. At the same time, the bias of the leaf spring 107 causes part of the ink conduit 5 to expand so that a wall of the ink conduit stays abutted with the hammer head 102. During priming, the resilient detents 112 slide through the opening 111 in the abutment plate 109 and hold the hammer mechanism 101 in a primed configuration by engaging with the rim 113 on an opposite side of the abutment plate, as shown in FIG. 15.

Figure 16:
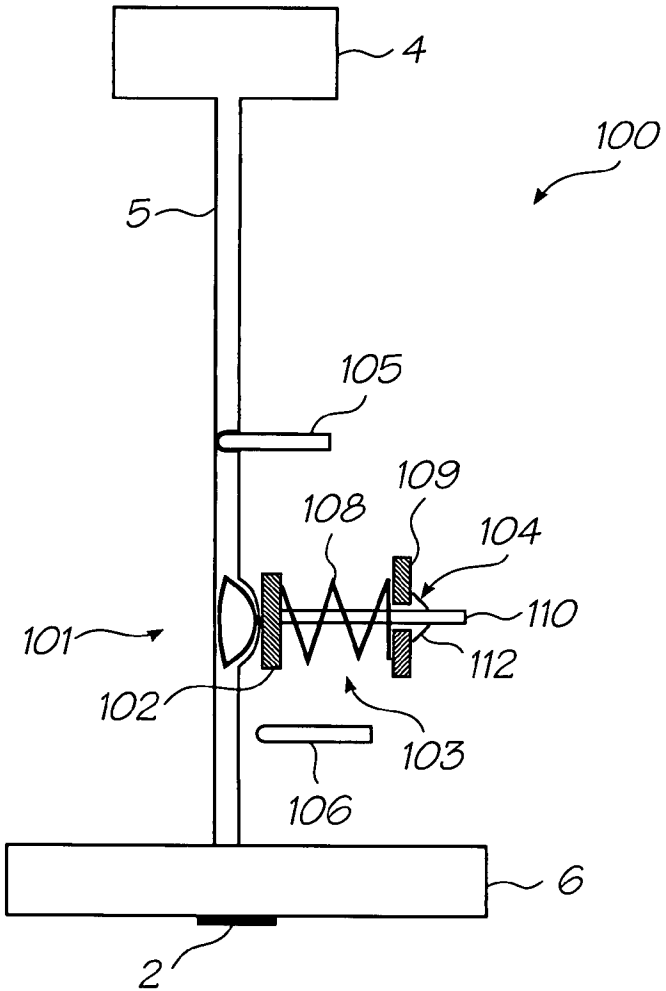
FIG. 16 is a schematic view of the ink supply system shown in FIG. 14 immediately prior to purging.

With the hammer mechanism 101 primed, the first pinch valve 105 is closed and the second pinch valve 106 is opened in third and fourth steps. FIG. 16 shows the ink supply system 100, as configured after the fourth step.

In a fifth step, the detents 112 are retracted into the shaft 110, allowing the shaft 110 to travel through the opening 111 under the force of the primed spring 108. Accordingly, the hammer head 102 urges against a wall of part of the ink conduit 5, forcing the ink conduit to contract, as shown in FIG. 17. Compression of the expanded ink conduit 5 causes ink 30 to purge from the printhead 2, flooding across the ink ejection face of the printhead 2.

At this point, the flooded ink 30 is typically removed from the ink ejection face by any suitable means. For example, the transfer roller 20 described with reference to FIGS. 1 to 5 may be used to remove the flooded ink 30.

With the flooded ink 30 removed, the ink supply system 100 is then configured for printing by re-opening the first pinch valve 105.

The hammer mechanism 101 may be used to provide a variety of purging pressures and/or purging volumes by the spring-loading mechanism 103 adopting different primed configurations. The extent to which the shaft 110 is retracted (FIG. 16) may be varied by the positions of the detents 112 on the shaft 110.

Figure 19:
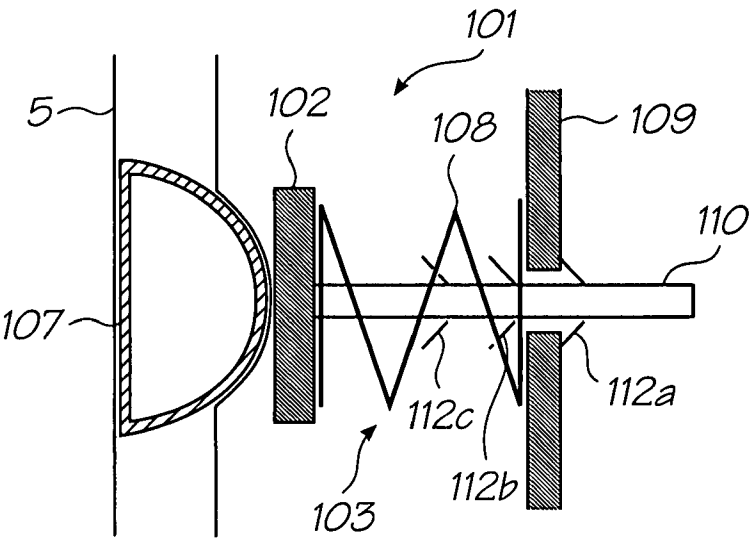
FIG. 19 is an enlarged schematic view of the hammer mechanism primed for a small purge.
Figure 21:
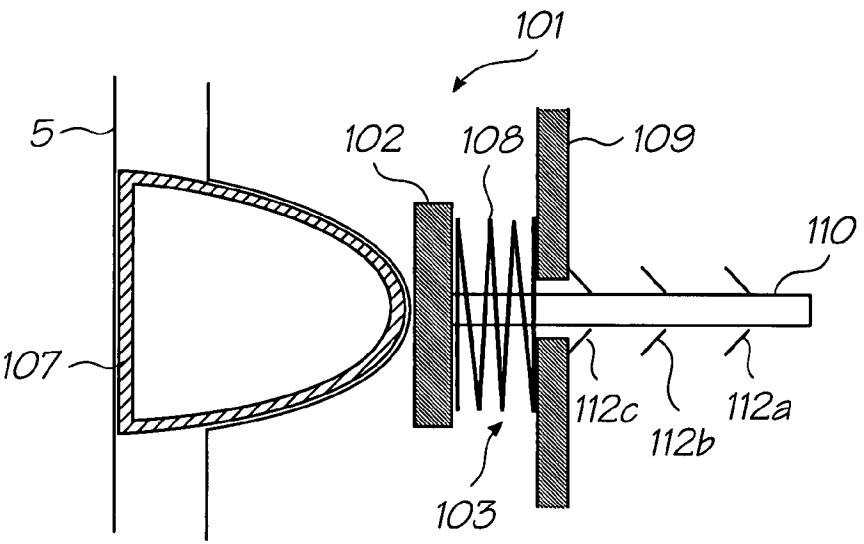
FIG. 21 is an enlarged schematic view of the hammer mechanism primed for a large purge.
Figure 20:
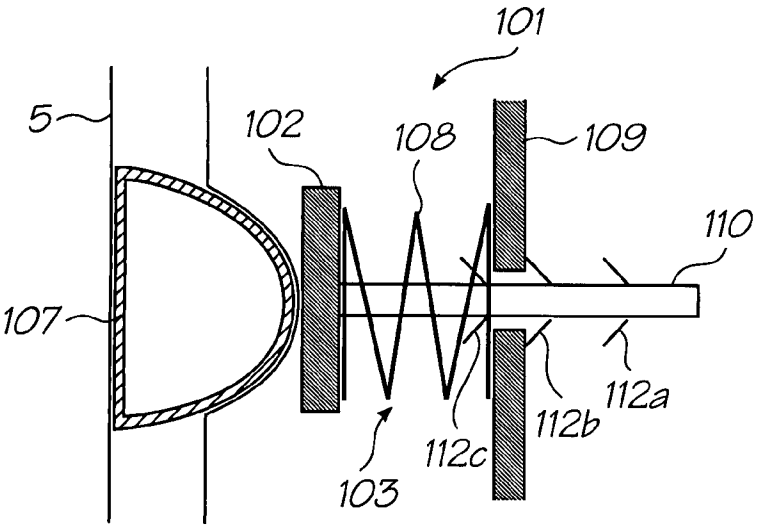
FIG. 20 is an enlarged schematic view of the hammer mechanism primed for a medium purge.

FIGS. 19 to 21 shows three different purge settings for the hammer mechanism 101. The shaft 110 has three detents 112*a*, 112*b* and 112*c* corresponding to three different purge settings. In FIG. 19, the shaft 110 is retracted as far as detent 112*a*, corresponding to a small purge volume/pressure. In FIG. 20, the shaft 110 is retracted as far as detent 112*b*, corresponding to a medium purge volume/pressure. In FIG. 21, the shaft 110 is retracted as far as detent 112*c*, corresponding to a large purge volume/pressure. Selection of a suitable purge volume/pressure is made by the controller 115 and may use feedback provided by the printhead 2 relating to, for example, the severity of nozzle blockage. Alternatively, the controller 114 may determine an extent of purge required from a period in which the printhead has been left idle.

Ink Supply System with Separate Purging Reservoir

In the ink supply systems 70, 90 and 100 described above, only one ink reservoir supplies ink to the printhead 2 for each color channel. In other words, the same ink reservoir supplies ink for both printing and purging. As will be appreciated from the above discussion, printing and purging place different demands on the ink reservoir—for purging a positive pressure is usually required; for printing a negative pressure is generally required in the reservoir. These conflicting requirements necessarily place demands on the design of the ink reservoir.

In addition, users may feel that they are wasting expensive ink during purging, and may be reluctant to purchase a printer that appears to consume seemingly large quantities ink for non-printing purposes.

Figure 22:
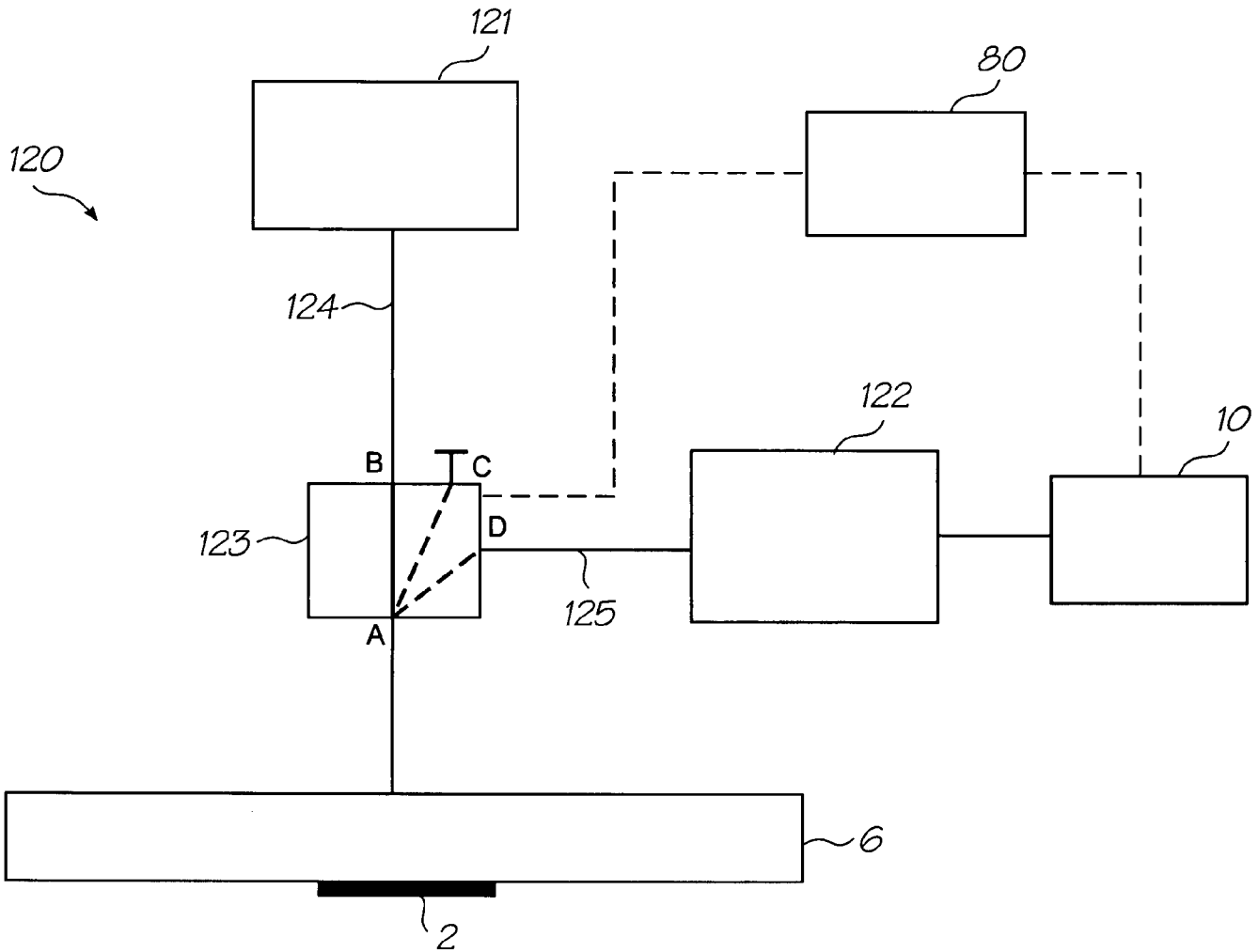
FIG. 22 is a schematic view of an ink supply system with separate printing and purging reservoirs.

In the ink supply system 120 shown in FIG. 22, there are two ink reservoirs for each color channel. A first ink reservoir 121 contains ink for printing, whereas a second ink reservoir 122 contains ink for purging. FIG. 22 only shows one color channel being fed into the ink manifold 6, but it will of course be appreciated that a plurality of color channels may be used, each with first (e.g. 121*a*, 121*b*, 121*c* and 121*d*) and second (e.g. 122*a*, 122*b*, 122*c* and 122*d*) ink reservoirs.

The printing ink in the first reservoir 121 and purging ink in the second reservoir 122 are identical. However, an advantage of this system is that the two inks may be sold at different prices, or the two reservoirs may have different volumes so that the second reservoir 122 never (or infrequently) runs out of ink during the lifetime of the printer.

A further advantage of this system is that only the second ink reservoir 122 need be positively pressurized by the pressure device 10 for purging. This allows more flexibility in the design of the first ink reservoir 121, which is required to maintain a negative pressure within a specific range for printing.

The printhead 2 fluidically connects to the first and second reservoirs 121 and 122 by means of a valve 123, which is switchable between a plurality of positions. In the configuration shown in FIG. 22, the valve 123 fluidically connects A-B so that the printhead 2 is in fluid communication with the first ink reservoir 121 via a first ink conduit 124. Hence, FIG. 22 shows a printing configuration for the ink supply system 120.

In a purging configuration, the valve 123 fluidically connects A-D so that the printhead 2 is in fluid communication with the second ink reservoir 122 via a second ink conduit 125.

In a sealing configuration, the valve 123 fluidically connects A-C, which seals the printhead 2 from both ink reservoirs 121 and 122. This configuration is suitable for transport, storage or other idle periods of the printhead 2.

Operation of the valve 123 and pressure device 10 is controlled by the controller 80, which may be used to coordinate printhead purging operations in an analogous manner to the controller 80 described above.

Ink Supply System with Cleaning Liquid Ink Reservoir

In the printhead maintenance systems 1 and 60 and ink supply systems 70, 90, 100 described above, it has been assumed that the ink reservoir(s) 4 all contain printing inks. Printing inks may include cyan, magenta, yellow, black or infrared inks.

Figure 23:
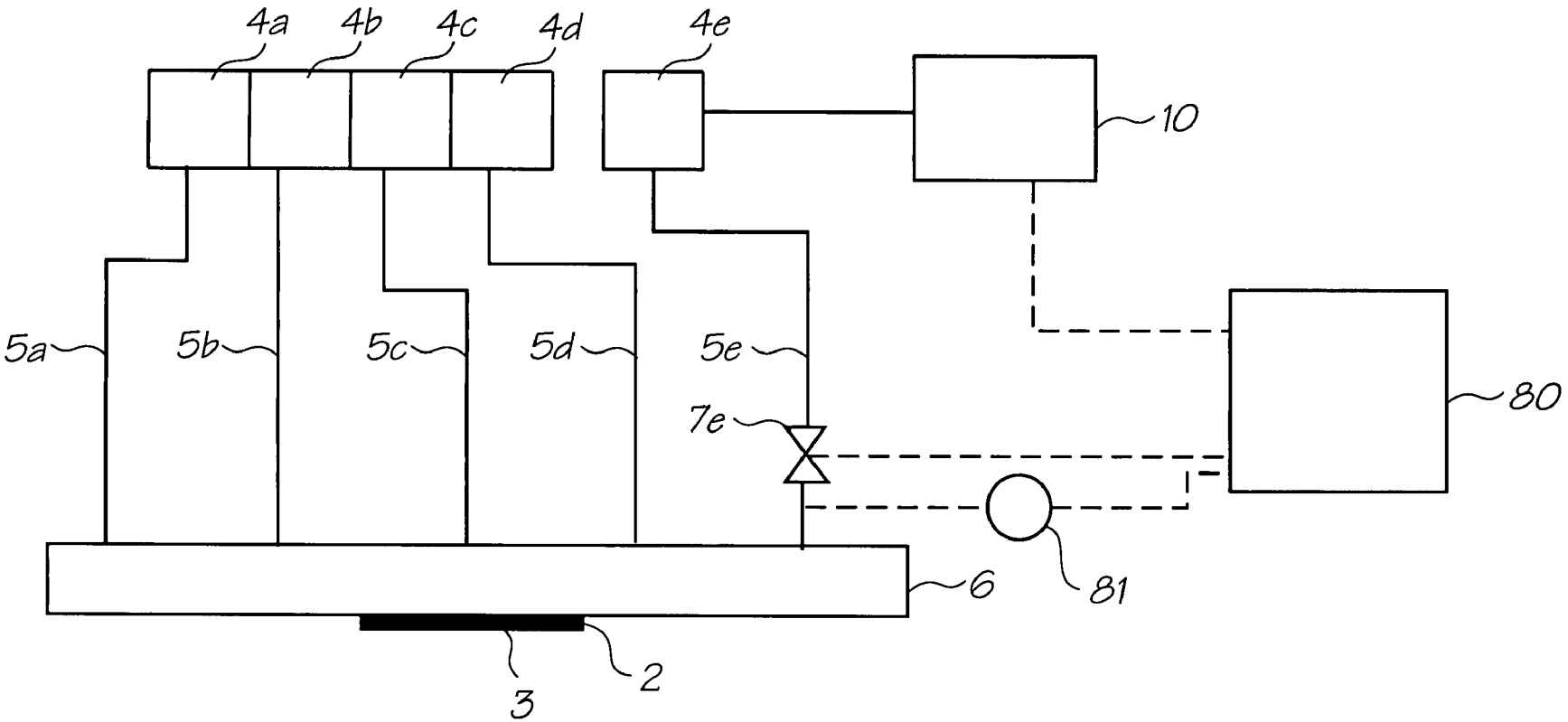
FIG. 23 is a schematic view of an ink supply system with a separate cleaning liquid reservoir.

In the ink supply system 130 shown in FIG. 23, the ink reservoirs 4*a*, 4*b*, 4*c* and 4*d* contain cyan, magenta, yellow and black inks for printing. However, a fifth ink reservoir 4*e* contains a cleaning liquid specifically adapted for purging the printhead 2.

The cleaning liquid contained in the ink reservoir 4*e* may be, for example, water, a dyeless ink base, an aqueous surfactant solution or an aqueous glycol solution. An advantage of a having a color channel dedicated to a cleaning liquid is that it has been found, experimentally, that water flooded across the ink ejection face 3 remediates blocked nozzles without the need for purging ink through each nozzle. The cleaning liquid additionally lifts any particulates from the ink ejection face 3, as described above for other inks. A further advantage of having an ink reservoir 4*e* containing cleaning liquid is that the cleaning liquid is cheap and readily replaceable, unlike the more expensive dye-based inks typically used in inkjet printing. A user may, for example, be able to simply top up the reservoir 4*e* with deionized water.

The ink reservoir 4*e* containing the cleaning liquid may be positively pressurized by a pressure device 10 analogously to the ink supply systems described above. Similarly, a solenoid valve 7*e* in a corresponding in ink conduit 5*e* may be used to control the supply of cleaning liquid into the printhead 2. Operation of the pressure device 10 and valve 7*e* may be controlled by a controller 80 in response to feedback provided by the pressure sensor 81. Hence, the controller 80 may be used to coordinate printhead purging operations.

The other ink reservoirs 4*a*, 4*b*, 4*c* and 4*d* are connected to the printhead 2 by respective ink conduits 5*a*, 5*b*, 5*c* and 5*d*, and supply ink for printing in the traditional manner. A further advantage of having a separate purging channel is that the main ink reservoirs 4*a*, 4*b*, 4*c* and 4*d* need not be specially adapted for purging, which allows greater flexibility in their design.

It will, of course, be appreciated that the present invention has been described purely by way of example and that modifications of detail may be made within the scope of the invention, which is defined by the accompanying claims.

The invention claimed is:

1. An ink supply system for an inkjet printhead comprising:

(a) an ink reservoir for storing ink, said ink reservoir being contained in a pressurizable chamber;

(b) an ink conduit interconnecting said ink reservoir and said printhead;

(c) an air compressor in fluid communication with said chamber; and (d) a valve positioned between said air compressor and said chamber;

(e) a first air conduit interconnecting an outlet of said air compressor and said valve; and (f) a second air conduit interconnecting an inlet of said air compressor and said valve, wherein said valve is switchable between:

a first configuration in which said valve interconnects said outlet and said chamber via said first air conduit; and a second configuration in which said valve interconnects said inlet and said chamber via said second air conduit, thereby providing active control of ink pressure in said ink reservoir and said printhead.

2. The ink supply system of claim 1 comprising a plurality of ink reservoirs.

3. The ink supply system of claim 2, wherein each ink reservoir has a respective ink conduit interconnecting each ink reservoir and said printhead.

4. The ink supply system of claim 1, wherein said switchable valve is a solenoid valve.

5. The ink supply system of claim 1, further comprising a controller for controlling operation of said air compressor and said switchable valve.

6. The ink supply system of claim 5 further comprising a pressure sensor for measuring a pressure in said ink reservoir or said ink conduit.

7. The ink supply system of claim 6, wherein said pressure sensor is in communication with said controller, said controller being configured to control said air compressor and said switchable valve in response to feedback provided by said pressure sensor.

8. The ink supply system of claim 5, wherein said ink conduit has a respective ink valve for controlling a supply of ink to said printhead, and said controller is configured for controlling operation of said ink valve.

9. The ink supply system of claim 1, wherein said ink reservoir comprises an ink bag containing ink.

10. The ink supply system of claim 1, wherein said ink conduit has a respective ink valve for controlling a supply of ink to said printhead.

* * * * *